US008256406B1

(12) United States Patent
Kirkpatrick

(10) Patent No.: US 8,256,406 B1
(45) Date of Patent: Sep. 4, 2012

(54) SYSTEMS AND METHODS FOR REGULATING PNEUMATIC GAS PROPULSION

(76) Inventor: Kevin Kirkpatrick, Cincinnati, OH (US)

( * ) Notice: Subject to any disclaimer, the term of this patent is extended or adjusted under 35 U.S.C. 154(b) by 0 days.

(21) Appl. No.: 13/150,685

(22) Filed: Jun. 1, 2011

Related U.S. Application Data

(63) Continuation of application No. PCT/US2011/038674, filed on Jun. 1, 2011.

(51) Int. Cl.
*F41B 11/00* (2006.01)

(52) U.S. Cl. ..... 124/73; 102/440

(58) Field of Classification Search ..... 124/73; 102/440

See application file for complete search history.

(56) References Cited

U.S. PATENT DOCUMENTS

| | | | | |
|---|---|---|---|---|
| 4,091,791 | A * | 5/1978 | Castelli et al. | 124/73 |
| 4,531,458 | A * | 7/1985 | Saxby | 102/440 |
| 4,539,969 | A * | 9/1985 | Saxby | 124/57 |
| 4,697,523 | A * | 10/1987 | Saxby | 102/440 |
| 4,936,282 | A * | 6/1990 | Dobbins et al. | 124/74 |
| 5,187,323 | A * | 2/1993 | Saxby | 102/440 |
| 5,265,582 | A * | 11/1993 | Bhogal | 124/73 |
| 5,700,972 | A * | 12/1997 | Saxby | 102/440 |
| 7,686,005 | B2 * | 3/2010 | Adams | 124/77 |
| 2006/0037597 | A1 * | 2/2006 | Wood | 124/73 |
| 2007/0272222 | A1 * | 11/2007 | Ho | 124/73 |
| 2009/0241931 | A1 * | 10/2009 | Masse | 124/76 |

FOREIGN PATENT DOCUMENTS

WO W09823909 6/1998

OTHER PUBLICATIONS

International Search Report and Written Opinion issued in PCT/US2011/038674, mailed Oct. 14, 2011.

* cited by examiner

*Primary Examiner* — Michael Carone
*Assistant Examiner* — Samir Abdosh
(74) *Attorney, Agent, or Firm* — Dinsmore & Shohl, LLP

(57) ABSTRACT

Embodiments disclosed herein include systems and methods for regulating pneumatic gas propulsion. More specifically, some embodiments include a first spring that exerts a spring force, where the spring set point increases as the first spring is compressed. Similarly, some embodiments include a piston that is in physical communication with the first spring and a valve. The valve mechanism may receive the gas, where upon the gas being received by the valve mechanism at a pressure that meets the spring set point, the gas causes the piston to move in the longitudinal direction. Further, movement of the piston creates a cylinder space between the piston and the valve mechanism, where a volume of the cylinder space is defined by a position of the piston. The pressure causes the piston to compress the first spring until an equilibrium exists between the gas force and the spring force.

23 Claims, 16 Drawing Sheets

SYSTEMS AND METHODS FOR REGULATING PNEUMATIC GAS PROPULSION

CROSS REFERENCE

This application is a continuation of PCT Application Number PCT/US11/38674, filed Jun. 1, 2011, which is hereby incorporated by reference in its entirety.

TECHNICAL FIELD

Embodiments disclosed herein include systems and methods for regulating pneumatic gas propulsion and, specifically to systems and methods for utilizing compressed gas to launch ballistic projectiles.

BACKGROUND

As the field of pneumatic projectile launching devices gains popularity, users desire greater consistency, power, and accuracy from their devices. As an example, many combat simulation games (such as paintball) utilize pneumatic cannon devices, which use air power instead of gun-powder to launch projectiles. As with any combat situation, the consistency, power, and accuracy of a weapon may have a great impact on the success of that weapon's user. Accordingly, many current pneumatic cannon devices are one of two designs. In a first current design, normal atmospheric air is rapidly urged through a tubular barrel by the sudden release of a mechanically driven piston. In the second design, pressurized gas is conducted from a pressure reservoir directly to the breach end of the barrel by tubular conduits.

In both cases, the impulse of the projectile may be variable according to the rise and fall of gas pressure within the tubular barrel and may be further affected by changes in temperature, such as environmental temperature change, changes in pressure within the device itself, and/or changes in the gas reservoir that are utilized by the pneumatic cannon device. As a consequence, consistency, power, and accuracy of the current pneumatic cannon device may be unreliable.

SUMMARY

Embodiments disclosed herein include systems and methods for regulating pneumatic gas propulsion. More specifically, some embodiments include a first spring that exerts a spring force in an oppositely longitudinal direction, wherein a spring set point indicates a gas force in a longitudinal direction to overcome the spring force to compress the first spring, wherein the spring set point increases as the first spring is compressed. Similarly, some embodiments include a piston that is in physical communication with the first spring, a valve mechanism that is coupled to a gas reservoir and in physical communication with the piston. The valve mechanism may receive the gas from the gas reservoir, where, upon the gas being received by the valve mechanism at a pressure that meets the spring set point, the gas causes the piston to move in the longitudinal direction. Further, in some embodiments, movement of the piston in the longitudinal direction creates a cylinder space between the piston and the valve mechanism, where a volume of the cylinder space is defined by a position of the piston (and may be user adjustable). Further, upon the pressure meeting the spring set point, the pressure causes the piston to compress the first spring until an equilibrium exists between the gas force and the spring force.

Similarly, some embodiments of a system include a gas reservoir that stores gas for launching a projectile and an assembly structure that is coupled to the gas reservoir. In some embodiments, the assembly structure includes a first spring that exerts a spring force in an oppositely longitudinal direction, where a spring set point indicates a gas force in a longitudinal direction to overcome the spring force to compress the first spring, and where the spring set point increases as the first spring is compressed. Also included is a piston that is in physical communication with the first spring and a valve mechanism that is coupled to the gas reservoir and in physical communication with the piston. The valve mechanism may receive the gas from the gas reservoir, where upon the gas being received by the valve mechanism at a pressure that meets the spring set point, the gas causes the piston to move in the longitudinal direction. Movement of the piston in the longitudinal direction may create a cylinder space between the piston and the valve mechanism, where a volume of the cylinder space is defined by a position of the piston. In some embodiments, upon the pressure meeting the spring set point, the pressure causes the piston to compress the first spring until an equilibrium exists between the gas force and the spring force. Some embodiments additionally include a barrel breach that is coupled to the assembly structure and a trigger that is coupled to the assembly structure and the barrel breach.

DETAILED DESCRIPTION

Embodiments disclosed herein include systems and methods in the field of pneumatic cannon devices having a tubular barrel through which a projectile is launched by compressed gas, such as a ball bearing (BB) gun, a pellet gun, a paintball gun, an airsoft gun, and similar pneumatic cannon devices. Specifically, this disclosure depicts a novel mechanism for delivery, metering, and regulating the compressed gas by such pneumatic cannon devices. This may be achieved through the use of a spring and a piston that are utilized to create a pressure threshold of incoming compressed gas. By creating the pressure threshold, the pressure of the incoming compressed gas may be regulated such that the pneumatic cannon device may launch projectiles with substantially the same gas pressure for each launch. In some embodiments the threshold may be user-adjustable.

Similarly, some embodiments include a mechanism to cause failure of delivery of pressurized gas under conditions that do not meet the pressure threshold. If the gas reservoir or other factors prevent the incoming gas pressure from reaching the threshold, embodiments disclosed herein may prevent the dispersal of any gas (as opposed to firing the pneumatic cannon device with reduced power), so the user can correct the problem. Therefore, delivery range consistency, propellant gas economy, accuracy, and precision of delivery of the projectile to its intended target may be achieved.

As such, embodiments disclosed herein may be configured for regulating pneumatic cannon gas propulsion. Such embodiments resolve issues of adiabatic lapse, prevent launch of the projectile at pressures below a predetermined threshold, and resolve or ameliorate variability in barrel pressure and associated projectile impulse due to gradual instantaneous changes in barrel pressures associated with the current state of the art devices. Accordingly, embodiments disclosed herein provide pneumatic cannon devices and related components for providing a consistent launch of the ballistic projectiles.

Figure 1:
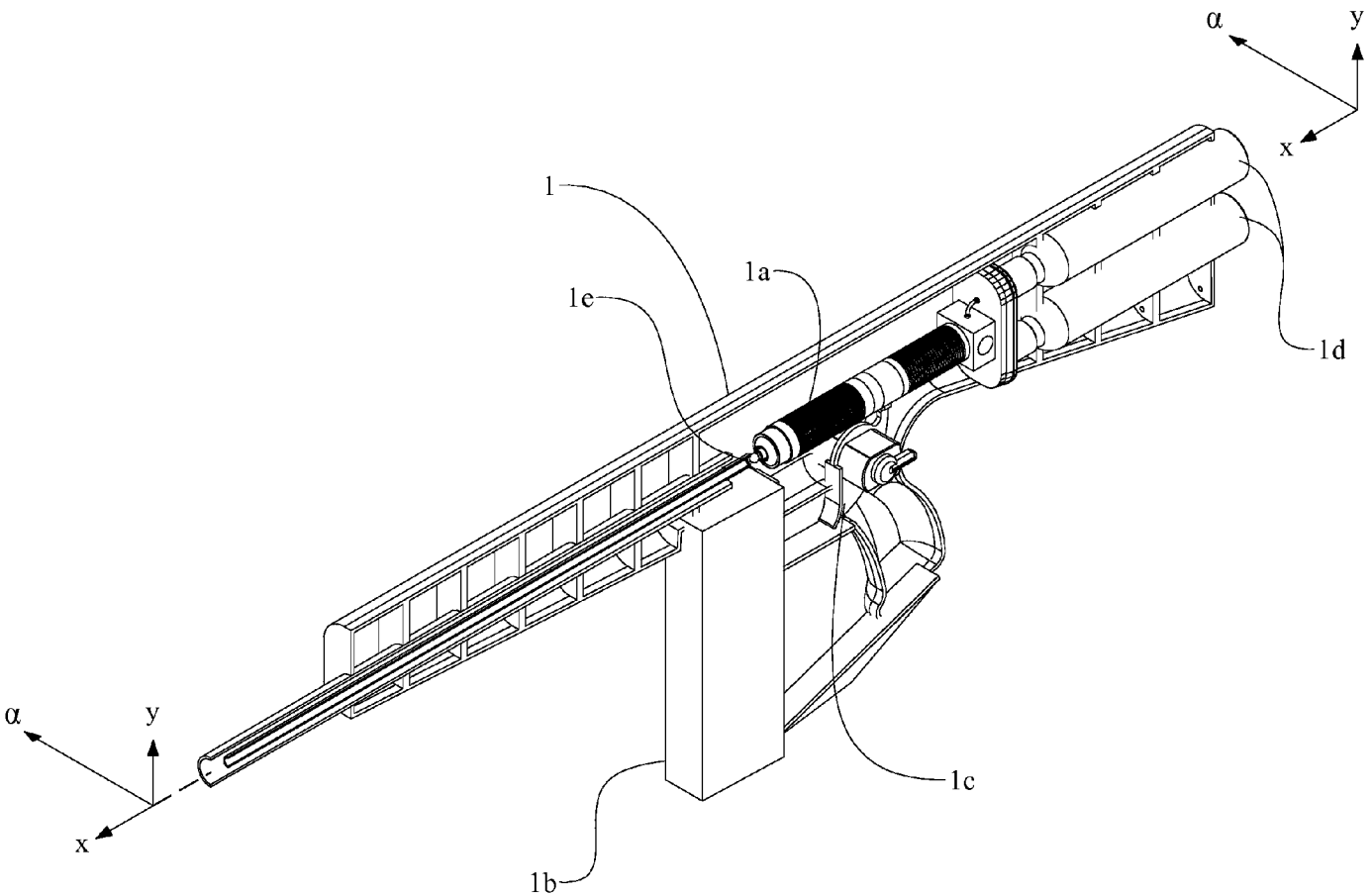
FIG. 1 depicts a pneumatic cannon device that uses an assembly structure as an extension of a barrel breach, according to embodiments disclosed herein.

Referring now to the drawings, FIG. 1 depicts a pneumatic cannon device 1 that uses an assembly structure 1*a* as an extension of a barrel breach 1*e*, according to embodiments disclosed herein. As illustrated, the pneumatic cannon device 1 may include an AA-12 replica device and/or other pneumatic cannon device, as described above. The assembly structure 1*a* may be coupled to a magazine of ammunition 1*b*, a barrel breach 1*e*, a trigger 1*c*, and a gas reservoir 1*d* (which may include one or more compressed air cartridges or other gas reservoirs). The magazine of ammunition 1*b* may provide ammunition to the pneumatic cannon device 1, such as BB pellets, paintballs, etc. to the assembly structure 1*a*. Upon a user actuation of the trigger 1*c*, the assembly structure 1*a* may receive air from the gas reservoir 1*d* for launching the ammunition through the barrel breach 1*e* in a predetermined direction. As discussed above, the assembly structure 1*a* provides a mechanism for providing consistent power and accuracy, regardless of external conditions.

Figure 9:
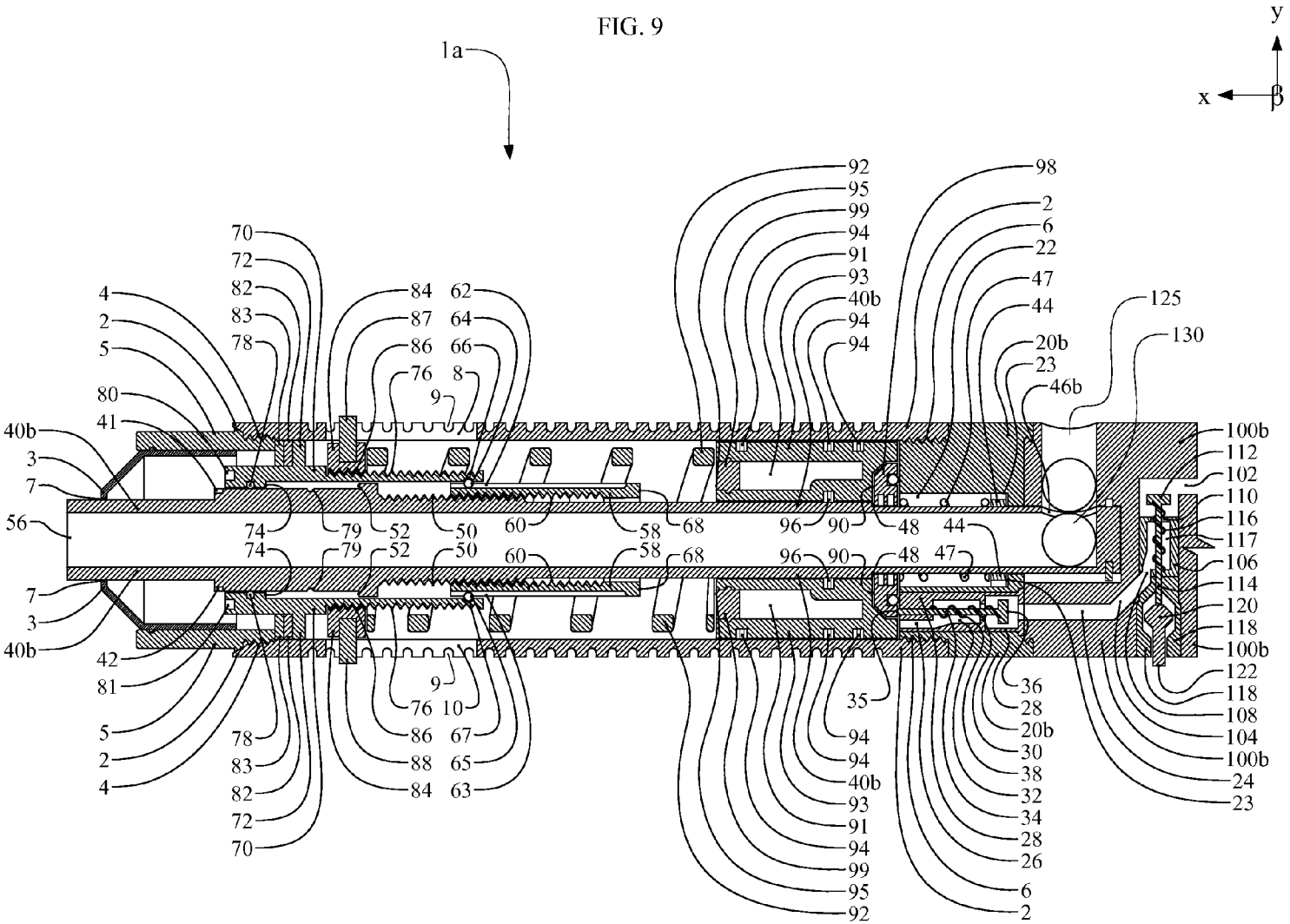
FIG. 9 depicts a rear loading version of the assembly structure, according to embodiments disclosed herein.
Figure 10:
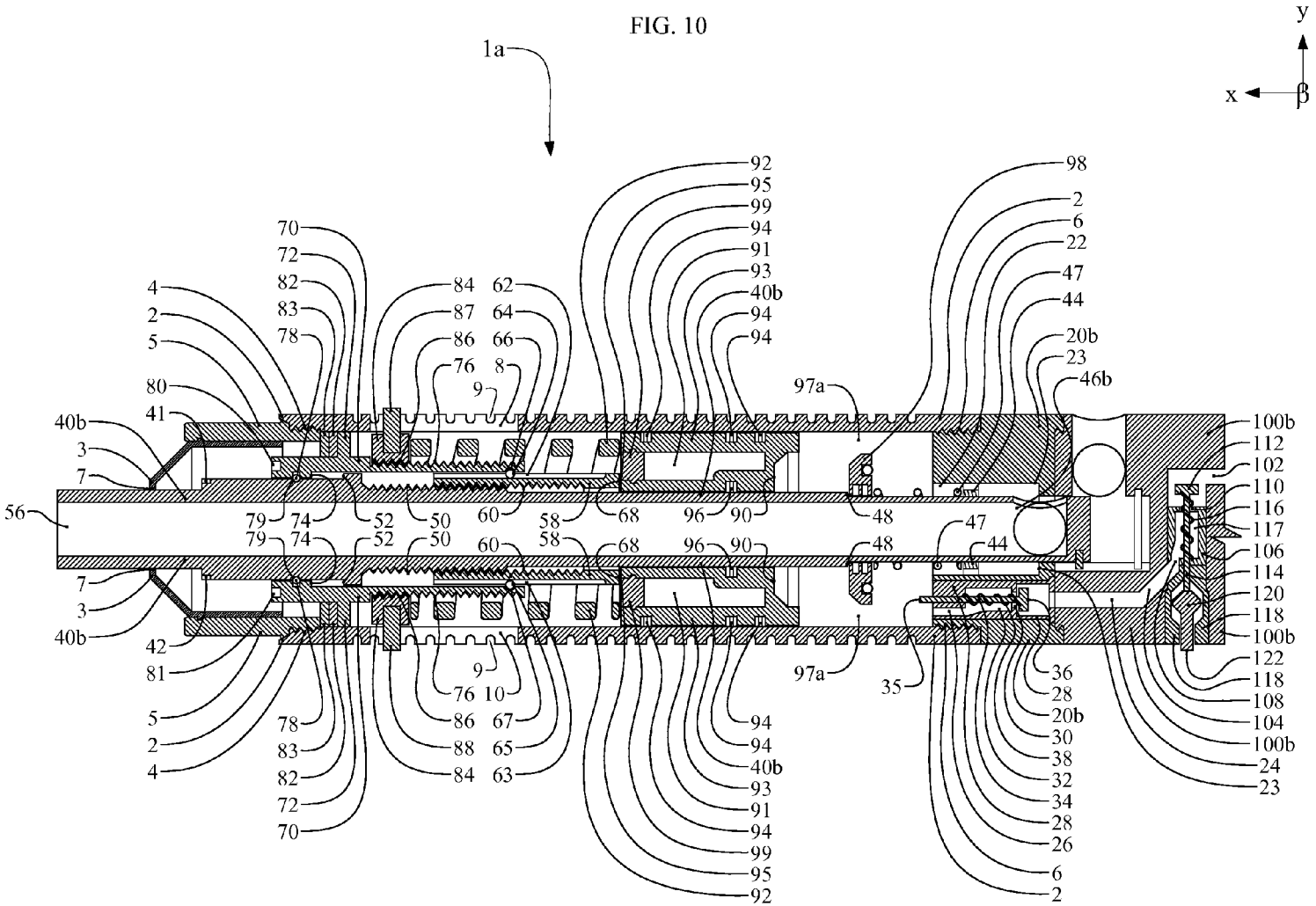
FIG. 10 depicts the rear loading version of the assembly structure as it applies to the operational cycle, according to embodiments disclosed herein.

It should be understood that while the pneumatic cannon device 1 is depicted in FIG. 1 as a front load device (e.g. the magazine of ammunition 1*b* provides the ammunition on the longitudinal side of the assembly structure 1*a*), this is merely an example. As described in more detail below, embodiments of the assembly structure 1*a* may be applied to a front loading pneumatic cannon device 1 and/or to a rear loading pneumatic cannon device (FIGS. 9 and 10). It should also be understood that in practice, the assembly structure 1*a* described herein may be integral to the pneumatic cannon device 1 at manufacture or may be inserted into an air-electric cannon device, as an aftermarket alteration.

Similarly, it should be understood that while an AA-12 pneumatic cannon device 1 is depicted in FIG. 1, this is also merely an example. Any type of pneumatic cannon device 1 may be utilized to provide the desired result. As such, the number, size, and position of the magazine of ammunition 1*b*, gas reservoir 1*d*, and barrel breach 1*e* may be altered to fit other designs.

Further, while the embodiment of FIG. 1 illustrates a pneumatic cannon device 1 that utilizes the gas reservoir 1*d*, this is also an example. More specifically, the embodiments disclosed herein may also be applied to a manual gas delivery system, such as a pump or other mechanism.

Figure 2:
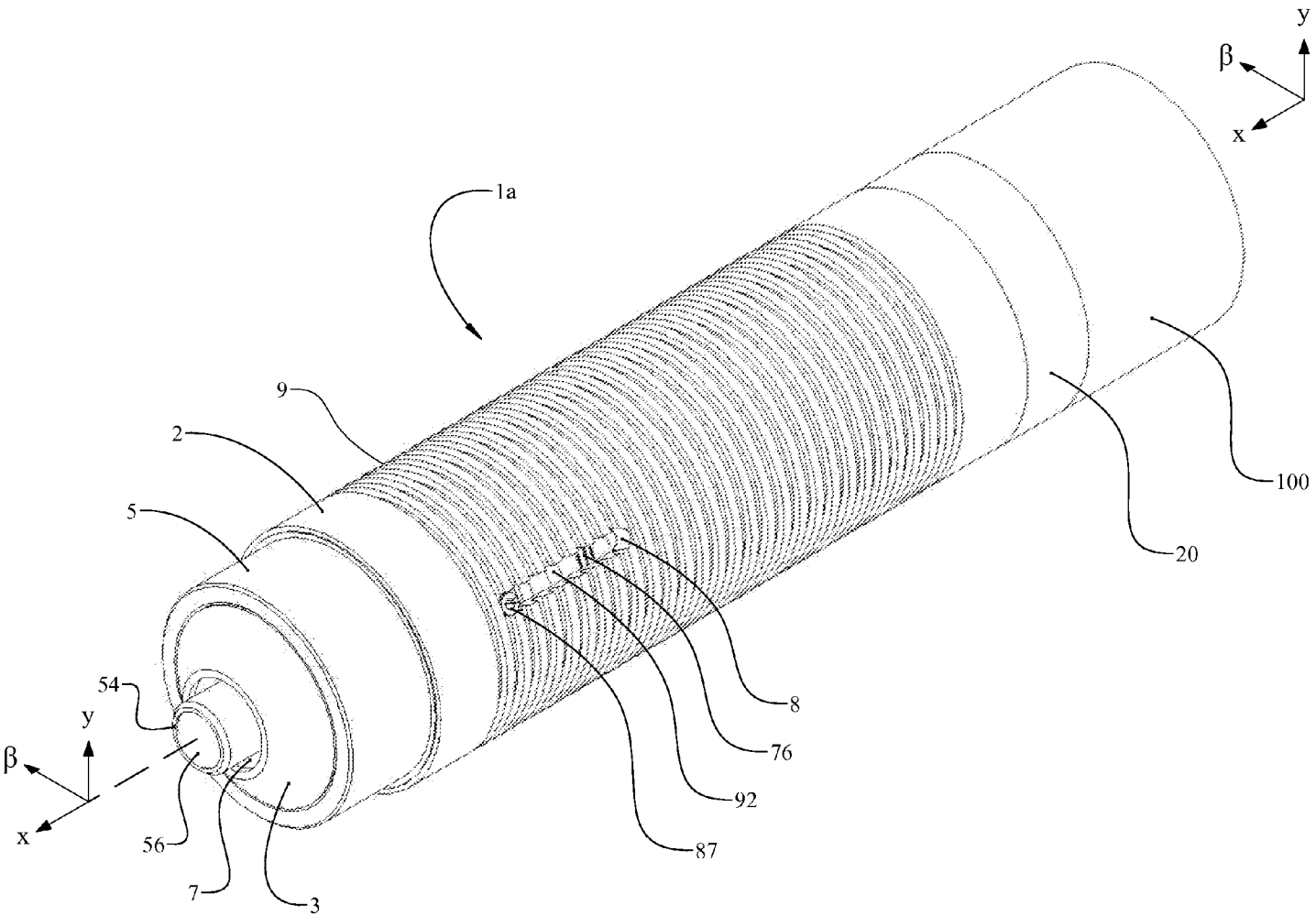
FIG. 2 depicts an assembly structure for regulating pneumatic cannon device propulsion, according to embodiments disclosed herein.

FIG. 2 depicts an embodiment of the assembly structure 1*a* for regulating pneumatic cannon gas propulsion. More specifically, FIG. 2 depicts the assembly structure 1*a* with a cylinder 2, and an annular sleeve 5. The cylinder 2 may include ornamentations 9, such as ridges, grooves, flanges, fins, etc., as described in more detail, below. Also included are a frangible cap 3, an annular opening 7, a longitudinal slot 8, a cylinder head 20, an adapter nipple 54, an open longitudinal end 56, helical threads 76, a protruding pin 87, a first spring 92, and a control block 100.

The annular sleeve 5 at the longitudinal end of the assembly structure 1*a* presents internal grooving with a direction bias. The frangible cap 3 is fixable and may be depressed into the open end of the annular sleeve 5. The frangible cap 3 may also be removable by cutting or tearing the frangible cap 3. The frangible cap 3 may be a consumable part that includes a tamper seal to provide evidence of regulation of the assembly structure 1*a*. More specifically, the frangible cap may evidence the current settings to the assembly structure, thereby indicating a pressure and/or power of the assembly structure 1*a*. The frangible cap 3 may be constructed of polyethylene thermoplastic or other suitable polymer generally acceptable for use in inexpensive tamper seals.

Also included in the example of FIG. 2 is a cylinder head 20 that is sized and fitted to hermetically cover the oppositely longitudinal end of the cylinder 2 (right side of FIG. 2, toward the back of the assembly structure 1*a*). In some embodiments, complementary helical threads are presented at the longitudinal end of the cylinder head 20 (left side of FIG. 2, toward the front of the assembly structure 1*a*), and the oppositely longitudinal end of the cylinder 2, to provide rigid assembly and disassembly of the cylinder 2 and/or the control block 100. Similarly, in some embodiments, the cylinder head 20 presents a longitudinally aligned annular recess for slidable assembly and disassembly.

Figure 3:
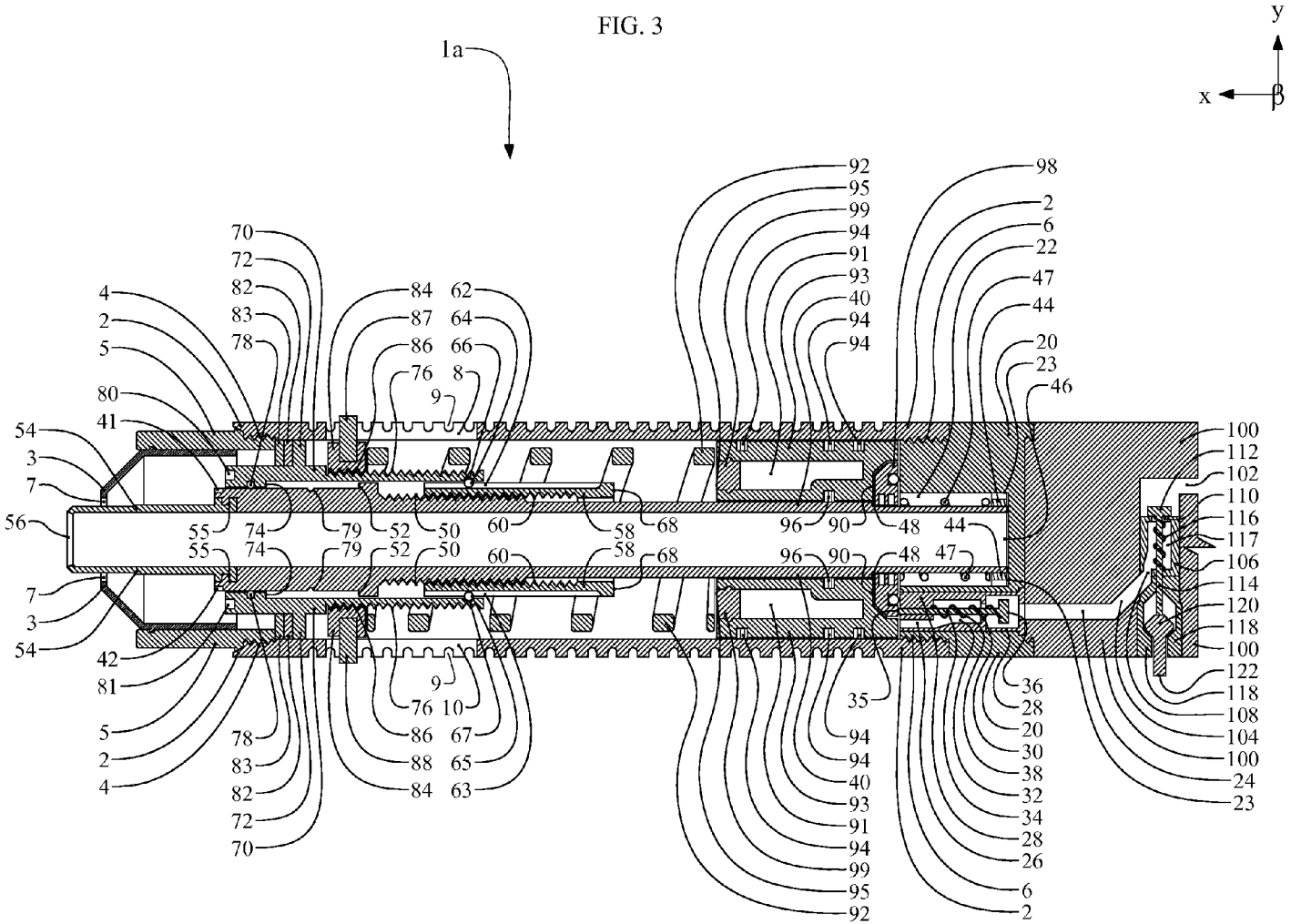
FIG. 3 depicts a cross sectional view of the assembly structure, according to embodiments disclosed herein.

FIG. 3 depicts a cross sectional view of the assembly structure 1*a* for the pneumatic cannon device 1, according to embodiments disclosed herein. As illustrated, the assembly structure 1*a* includes the cylinder 2 with an interior annular passage, which may be substantially circular in cross-section and have longitudinal orientation (but viewed in the side view of FIG. 3 as rectangular). The interior annular passage may be open throughout its length at both its longitudinal (left side in FIG. 3, ending at the open longitudinal end 56) and oppositely longitudinal ends (right side in FIG. 3) as mechanism for slidable location and axial alignment of a piston 93. The assembly structure 1*a* may also include an external surface figured with ornamentations 9, such as ridges, grooves, flanges, fins, etc. to increase surface area as a mechanism of increasing heat exchange. The external surface may also be figured with helical threads 4 proximate to its longitudinal end, additional helical threads 6 proximate to its oppositely longitudinal end, which may be utilized as a mechanism for removably securing the annular sleeve 5 and cylinder head 20 respectively.

Adjacent to the cylinder head 20 is a tubular opening 46 in the oppositely longitudinal end of a tubular linkage 40. Longitudinal slots 8 and 10 may also be included and may be approximately intermediate between ends of the external surface as a longitudinally slidable (slidable in the longitudinal direction) and oppositely longitudinally slidable (slidable in the oppositely longitudinal direction) mechanism for location and alignment of the spring footing mechanism 84. Also included are a spring footing mechanism 84 and its associated protruding pin 87 and protruding pin 88, and a first spring 92, each of which is described in more detail, below.

Further, the compression (referred to herein as "$L_1$") may be pre-loaded by helical threads 86 in association with the complimentary helical threads 76 present on a quill 70 and in association with the collection of at least the following: a longitudinal surface of flange 72, a cylinder space 97 (depicted in FIGS. 6 and 7), a thrust washer 82, a thrust washer 83, and an oppositely longitudinal surface of annular sleeve 5. These components may constitute a rotary bearing. Additionally, the collection of the spring footing mechanism 84, the protruding pin 87, and the protruding pin 88 (in association with longitudinal slots 8 and 10, which constrain rotation of the spring footing mechanism 84), translate rotations of the quill 70 into longitudinal and oppositely longitudinal linear motions of the spring footing mechanism 84.

Accordingly, the quill 70 may be configured to present an external helical thread and a shouldering mechanism 52. The longitudinal surface of the flange 72 constitutes a rotational thrust bearing surface and recesses within the inner annular surface proximate to the oppositely longitudinal end to accommodate ball bearings. Such ball bearings may be exposed and protrude radially inward and radially aligned with longitudinal grooves presented in the outer annular surface of the telescoping tubular sleeve and constitute a slidable linear bearing surface and mounting mechanism configured to prevent relative rotation of the telescoping tubular sleeve. The longitudinal end of the quill 70 also presents pocketed ball bearings within the interior annular surface, which are longitudinally aligned with an annular groove 79 on the longitudinal end of the tubular linkage 40, when the tubular linkage 40 is in its most longitudinal position, and constitutes a ball bearing detent 78. The longitudinal end surface of the quill 70 presents recesses which afford threaded adjustment of the spring footing mechanism 84 with a wrench (not illustrated), which constitutes a tubular pin spanner.

An annular nut of circular cross-sectional profile may also be included, having helical threads presenting on the inner annular surface complimentary to the external helical threads detailed in the quill 70. The annular nut presents split pins that are press fit into recesses radially aligned with the slots detailed in the cylinder 2. Such split pins constitute protruding fingers engaged within the cylinder slots that restrict axial rotation of the annular nut while permitting longitudinal travel of the nut within the length of the slots. Such composition of nut and pins constituting a threadedly adjustable spring footing mechanism 84 for the first helical spring facilitating the adjustment of the $L_1$ pre-load force of the first spring 92 and therefore the pressure of the gas within the cylinder 2.

The combined collection of the cylinder 2, the piston 93 and its associated elastomeric seals, the piston outer seal 94, the piston inner seal 96, the tubular linkage 40, the annular sleeve 5, the cylinder head 20, the spring footing mechanism 84, the quill 70, and the annular sleeve 5 constitute a pneumatic pressure vessel and the mechanism for adjustable confinement of a discrete volume of pressurized gas and may be referred to collectively herein as the cylinder space 97.

Additionally, the cylinder head 20 presents a gas inlet port 26 as a mechanism for admitting gas flows to the cylinder space 97 (FIGS. 6 and 7 and described in more detail, below), the Schrader valve 28, and the gas supply port 24 (FIGS. 4-11), which operate as a valve mechanism and conduit to control and direct gas flows into the cylinder space 97 from a gas pressure source or reservoir. The Schrader valve 28 may be configured for regulating admission of compressed gas flows, into the interior space of the cylinder 2 between the longitudinal surface of the cylinder head 20 and the oppositely longitudinal surface of the piston 93, through the above inlet port, such that while the Schrader valve stem 34 is compressed toward the oppositely longitudinal direction, gas flows are permitted, and such that they are not permitted otherwise.

Additionally, actuation of the Schrader valve 28 occurs in association with a valve actuator surface 35, when depressed by a ring seal body 98. This action may be in association with the oppositely longitudinal surface of annular recess 90 for accommodation of ring seal body 98, within piston 93, and its own association with first spring 92, providing the mechanism by which ring seal body 98, depresses the valve actuator surface 35 and associated valve stem 34, in opposition to Schrader valve spring 38, unseating seatable element 36, and permitting gas flows through valve seat annulus 30, through valve body annulus 32. This may cause the opening of the gas supply port 24 to gas inlet port 26 and permit gas flows into a cylinder space 97 (FIGS. 6 and 7) if pressurized gas is present within gas supply port 24. The pressurized gas is provided by a reservoir or pressurized gas source (such as the gas reservoir 1*d* from FIG. 1) superior to gas supply conduit 102 presented by mounting and control block 100.

In some embodiments disclosed herein, the ring seal body 98 is fitted loosely within the interior of the piston 93 annular recess 90, and is composed of or is fitted with features containing elastomeric material suitable for hermetically covering the annular well 23 of the cylinder head 20. In one embodiment, the ring seal body 98 may include a thick metal washer which is figured on its oppositely longitudinal surface to accept an annular elastomeric ring with a profile that slightly extends oppositely longitudinally beyond the oppositely longitudinal surface of the ring seal body 98, such that it will compress against the longitudinal surface of the cylinder head 20, such that the ring seal body 98 operates as a valve mechanism. Upon seating, the ring seal body 98 compresses the Schrader valve stem 34 to permit pressurize gas flows into the cylinder 2, while simultaneously preventing flows from the cylinder 2 through the annular well 23 of the cylinder head 20, and thence into the open end of the tubular linkage 40.

Additionally, the ring seal body 98 may present a longitudinally and axially aligned channel that is fitted to the most oppositely longitudinal portion of the tubular linkage 40, such that it is slidable between the proximate shoulder and the serrated flange 44. This annular passage is figured within its internal annular surface to accommodate elastomeric rings, such that they extend slightly radially inward to compress against the outer annular surface of the tubular linkage 40 described above.

Flows of pressurized gas are made selectively present at gas supply port 24 by a user controlled Schrader valve body 106 by a user applying pressure on trigger linkage actuation surface 122 (which is housed in a Schrader valve body 106), moving a trigger linkage 120 and associated valve stem 114 in opposition to associated spring 116, thereby unseating seatable element 112 and permitting gas flows through valve seat annulus 110 into valve body annulus 117, through conduit 104, through conduit 108, such that, upon depressing the trigger linkage actuation surface 122, pressurized gas flows as may be present at the gas supply conduit 102 are communicated to gas supply port 24 and are otherwise not present.

Prior to user actuation of trigger linkage 120, the natural state of the assembly structure 1*a* is such that the user controlled Schrader valve body 106 is normally closed. This prevents such pressurized gas flows as may be available from the gas reservoir 1*d*. Accordingly, the first spring 92 is in its least compressed $L_1$ pre-load, operational length, the piston 93 resides in its most oppositely longitudinal position, with the ring seal body 98 encompassed within the annular recess 90 and compressed against the longitudinal surface of cylinder head 20 by the oppositely longitudinal surface of the annular recess 90 of the piston 93, and the valve actuator surface 35 of the Schrader valve 28 is depressed by the oppositely longitudinal surface of the ring seal body 98, opening the Schrader valve 28, and permitting such gas flow as may be presented to pass into the cylinder space 97.

Additionally, the cylinder head 20 presents an annular well 23 in its longitudinal surface, which accommodates the oppositely longitudinal open end of a tubular linkage 40 and its associated parts. The tubular linkage 40 presents a step reduction in diameter proximate to its oppositely longitudinal end such that an external annular shouldering mechanism 48 is provided upon which ring seal body 98 is slidably fitted and constrained in its most longitudinal travel by this external annular shouldering mechanism 48, and upon which a serrated flange 44 is affixed. A serrated flange 44 is also included and may have an axially and longitudinally aligned annular passage throughout and may have a radial array of longitudinally aligned semi-annular grooves in the profile of its outer circumference. The outer circumference being slidably fitted to the interior of the cylinder head 20, the grooves of which provide passage for gas flows from the cylinder space 97 (FIGS. 6 and 7), through an annular passage 22 between the annular well 23 and the oppositely longitudinal, reduced diameter section of the tubular linkage 40, and into the open end of the internal annular passage of the tubular linkage 40.

A second spring 47 is fitted about the oppositely longitudinal, reduced diameter section of the tubular linkage 40, between the ring seal body 98 and serrated flange 44 and is associated with both, such that the ring seal body 98 is normally urged in a longitudinal direction away from the serrated flange 44. The second spring 47 is wound such that the second spring force it applies longitudinally to the ring seal body 98 is less than the least spring force applied oppositely longitudinally to the ring seal body 98 by the piston 93 and associated first spring 92. Also included is an external annular shouldering mechanism 48 proximate to the oppositely longitudinal end of the tubular linkage 40, which is utilized with the second spring 47 and the serrated flange 44 to constrain the limits of longitudinal motions of the ring seal body 98.

Also included is a shouldering mechanism 52 that confines the tubular linkage 40 to a maximum limit. The shouldering mechanism 52 is included in the event of multiple catastrophic failures that could otherwise turn the tubular linkage 40 into a projectile. In ordinary function, the extent of longitudinal motion is determined by the load on the first spring 92 and the spring set point at which the ring seal body 98 is forced open. The spring set point may include a gas force in a longitudinal direction that may be utilized to overcome the spring force to compress the first spring 92. The spring set point increases as the first spring 92 is compressed. A retaining safety stop 74 is also included and associated with the shouldering mechanism 52.

Further, the quill 70 presents within the oppositely longitudinal end of its interior annular passage, a hemispherical cavity 66 and a hemispherical cavity 67 fitted to accommodate a ball bearing 64 and a ball bearing 65. The ball bearings 64, 65 protrude radially inward into the interior annular passage. A telescoping tube 58 presents a longitudinally aligned groove 62 and a groove 63 about its outer annular surface. Additionally, the telescoping tube 58 is radially aligned with the ball bearings within the interior surface of the quill 70 and fitted to provide a slidable linear bearing that permits the telescoping tube 58 longitudinal and oppositely longitudinal travel, while constraining its axial rotation. The interior axially and longitudinally aligned annular surface of the telescoping tube 58 provides helical threads 60 throughout its length.

The intermediate section of tubular linkage 40 presents helical threads 50 complimentary to and fitted within the helical threads 60, such that the collection of parts that includes the annular sleeve 5 in association with the thrust washer 82, the thrust washer 83, the flange 72 and its associated quill 70, the grooves 62 and 63, the ball bearings 64 and 65, the hemispherical cavities 66 and 67, and telescoping tube 58 constitute a slidable mounting mechanism for the tubular linkage 40. With the telescoping tube 58 constrained against axial rotation relative to quill 70, axial rotation of the tubular linkage 40 is threadedly translated into longitudinal and oppositely longitudinal adjustment of telescoping tube 58 by mechanism of a specialized wrench at wrench engagement recess 41 and wrench engagement recess 42 presented proximate to the longitudinal end of tubular linkage 40.

The piston 93 presents an annular interior passage fitted for longitudinally and axially aligned mounting of a tubular linkage 40, which presents a further annular interior passage with longitudinal and axially aligned cylindrical cross-section as the mechanism of egress for pressurize gas flow from cylinder space 97 (FIGS. 6 and 7), and tubular linkage 40 and ring seal body 98 similarly provide a valve mechanism and a gas supply conduit 102 to control and direct gas flows leaving the cylinder space 97. The piston 93 may also include a longitudinal surface 95.

The annular interior passage 91 may be covered by an annular cap 99, which allows the interior space of the piston 93 to have granular ballast added. This configuration changes the weight and felt impact of the piston 93. This configuration also changes both the resonance of the piston 93 and the first spring 92, which also alters the cycle time and firing rate. This configuration also changes the impact imparted to the cylinder head 20, which may be felt as an emulation of firearm recoil. This configuration may be utilized to provide tactile realism without the parasitic expense of additional pressurized gas used to produce simulated recoil.

Also included are annular grooves 55. The annular grooves 55 are utilized for the engagement of the adapter nipple 54 to affix and align the adapter nipple 54 to the longitudinal end of the tubular linkage 40. A retaining safety stop 74 is also included and associated with the shouldering mechanism 52.

Figure 6:
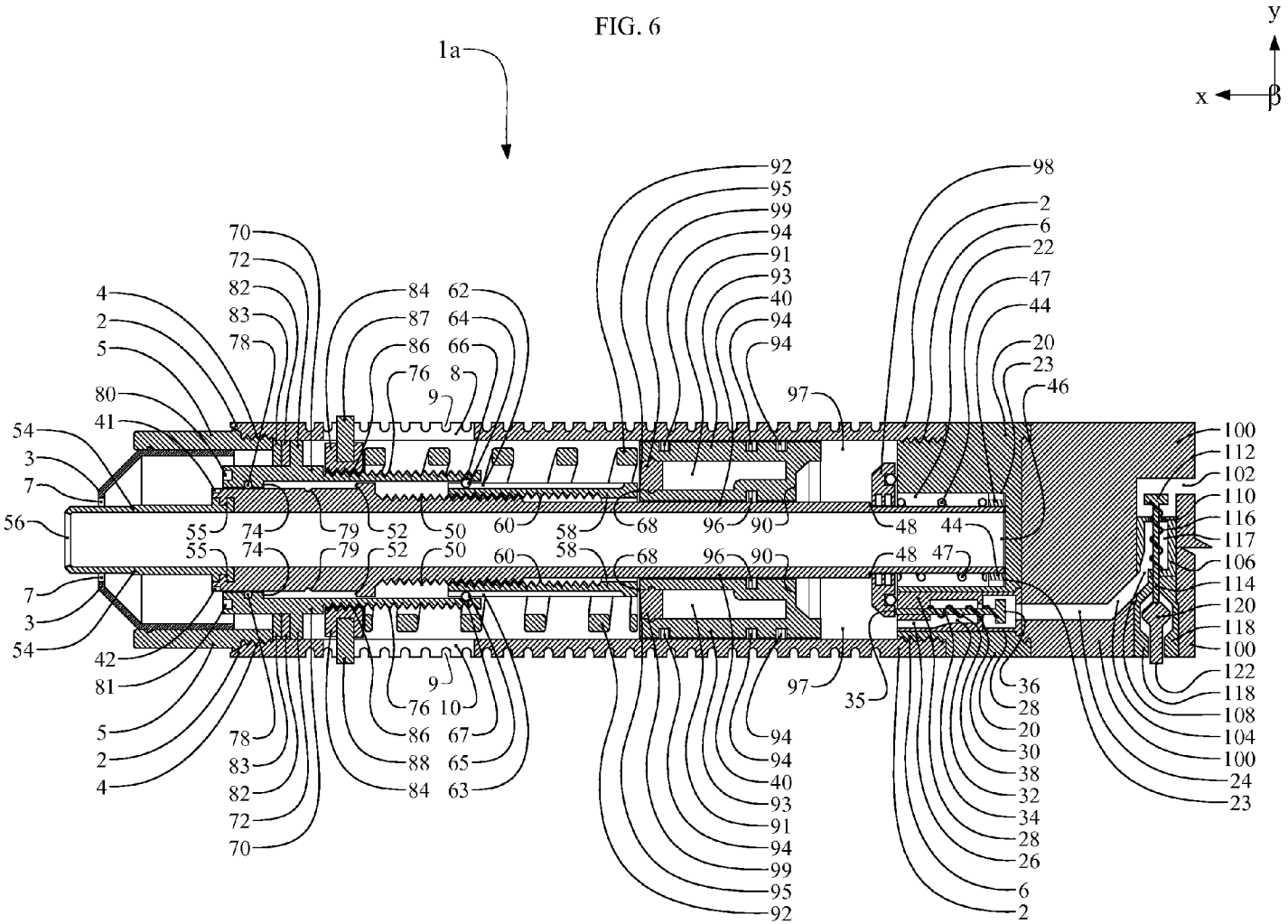
FIG. 6 depicts the assembly structure, further illustrating initial longitudinal piston motion, according to embodiments disclosed herein.
Figure 7:
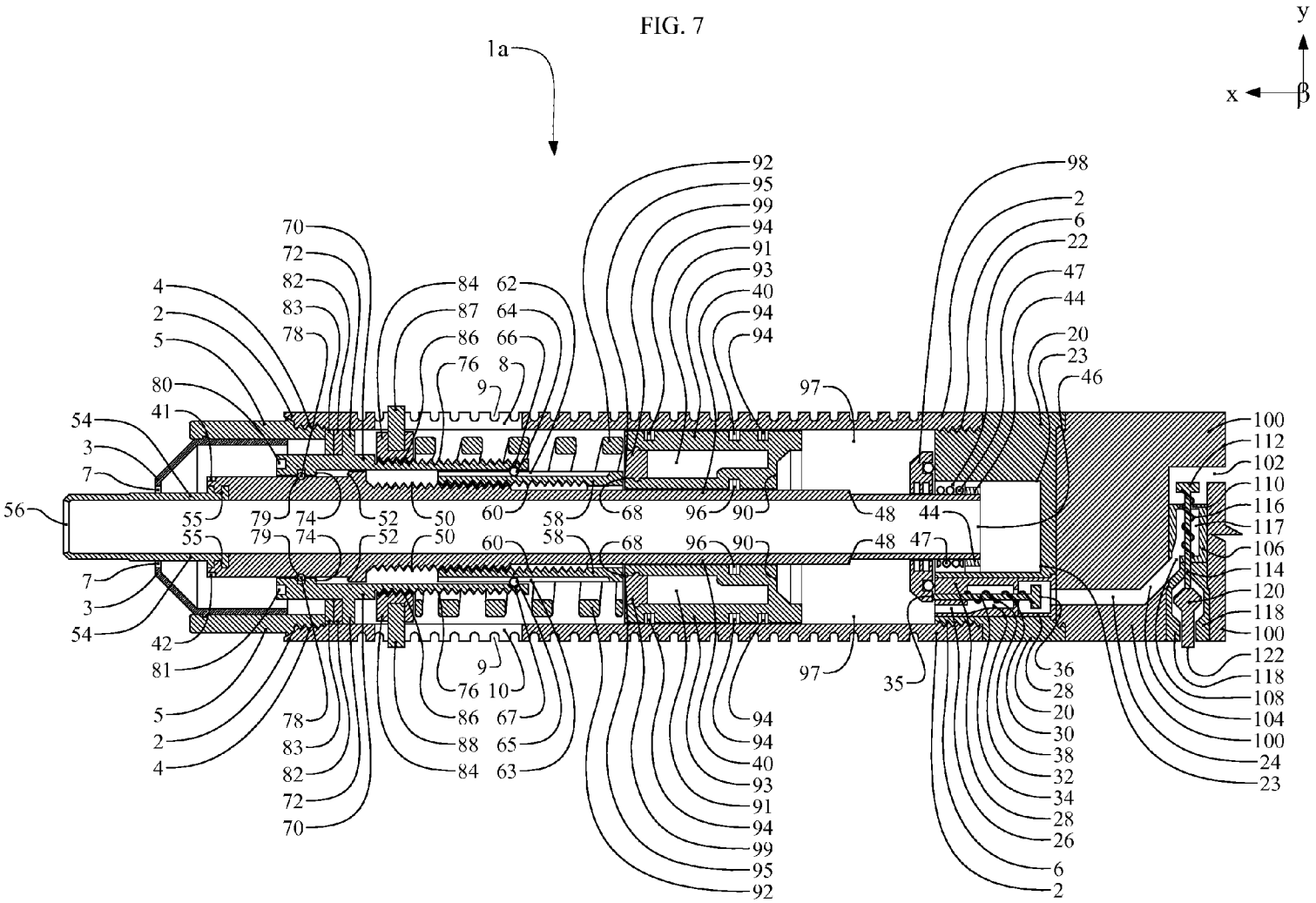
FIG. 7 depicts the assembly structure, further illustrating longitudinal motion of the piston, according to embodiments disclosed herein.

Adjustment of telescoping tube 58 and its associated oppositely longitudinal control surface 68 longitudinally and oppositely longitudinally offsets the distance the piston 93 is displaced by the admission of pressurized gas flows to the cylinder space 97 (FIGS. 6 and 7). This may occur prior to the longitudinal surface 95 of the piston 93 impinging upon the control surface 68, while the adjustment of the spring footing mechanism 84 advances the first spring 92 loading curve, and thus embodiments disclosed herein regulate both the volume and the pressure of the pressurized gas admitted to cylinder space 97. The valve mechanism employed to permit the outflow of the regulated pressurized gas charge accumulated within cylinder space 97 is dependent upon a preset minimum volume and preset minimum pressure to both be met prior to the ring seal body 98 becoming unseated, eliminating or ameliorating adiabatic lapse or environmental temperature effects as a factor in the consistency of the propellant charge so produced.

Upon unseating of the ring seal body 98 and subsequent release of the regulated propellant gas charge from the cylinder space 97 to the barrel, the piston 93 responds to the drop in pressure by moving oppositely longitudinally within the cylinder 2 such that the gas pressure is approximately maintained at equilibrium with the first spring 92 force applied to the piston 93 at any instantaneous moment of the spring's loading curve.

Figure 4:
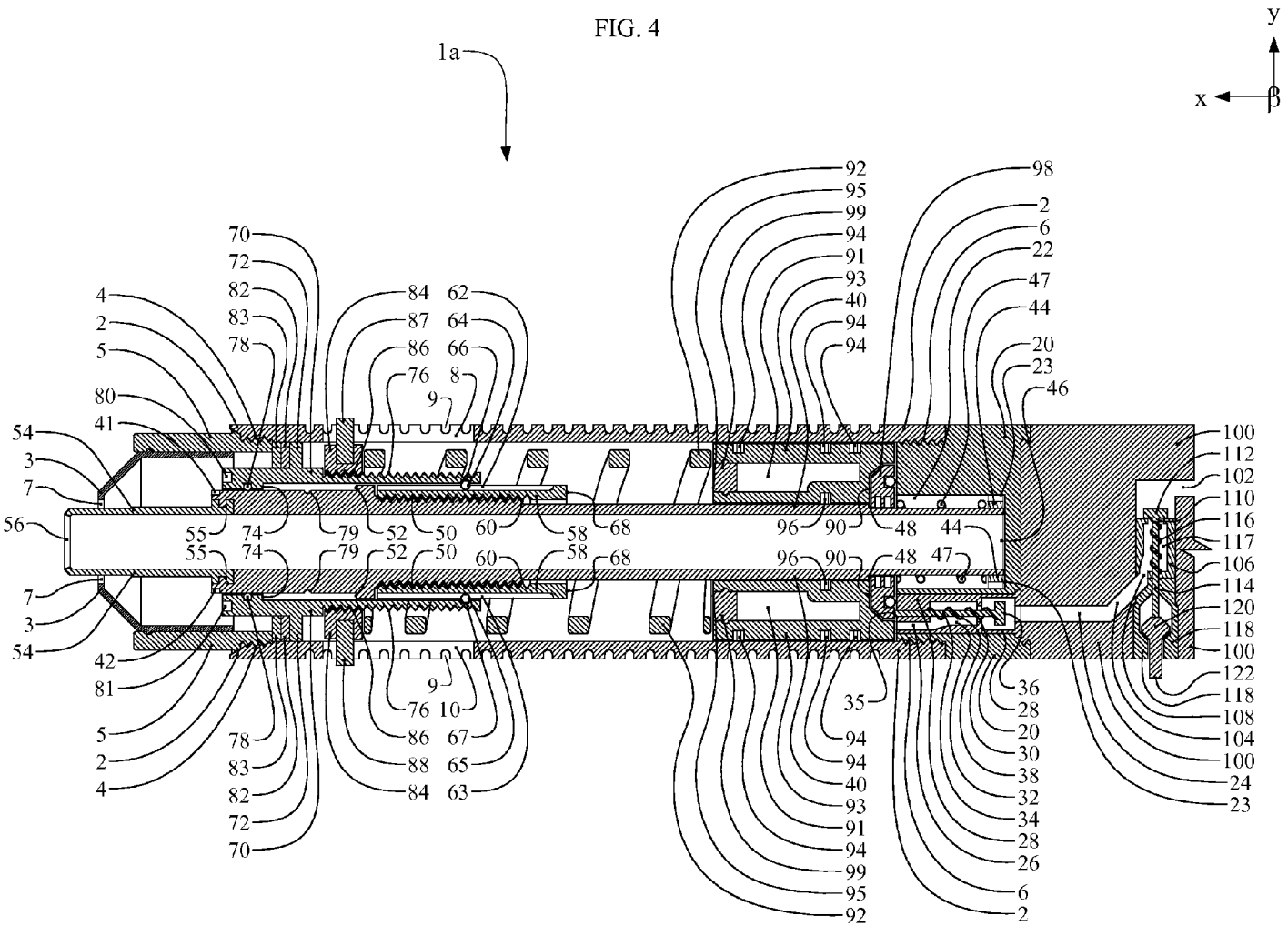
FIG. 4 depicts the assembly structure, further illustrating a tubular linkage telescopingly and longitudinally retracted, according to embodiments disclosed herein.

FIG. 4 depicts the assembly structure 1*a*, further illustrating a tubular linkage 40 telescopingly and longitudinally retracted, according to embodiments disclosed herein. As described above, the telescoping tube 58 may be telescoped in the longitudinal offset position from FIG. 3. This user-adjustable setting determines a volume of gas that is received in the cylinder space 97 (FIGS. 6 and 7) during operation. As such, the control surface 68 is a backstop for the longitudinal surface 95 of the piston 93. The longitudinal surface 95 interoperatively associates with the first spring 92.

Figure 5:
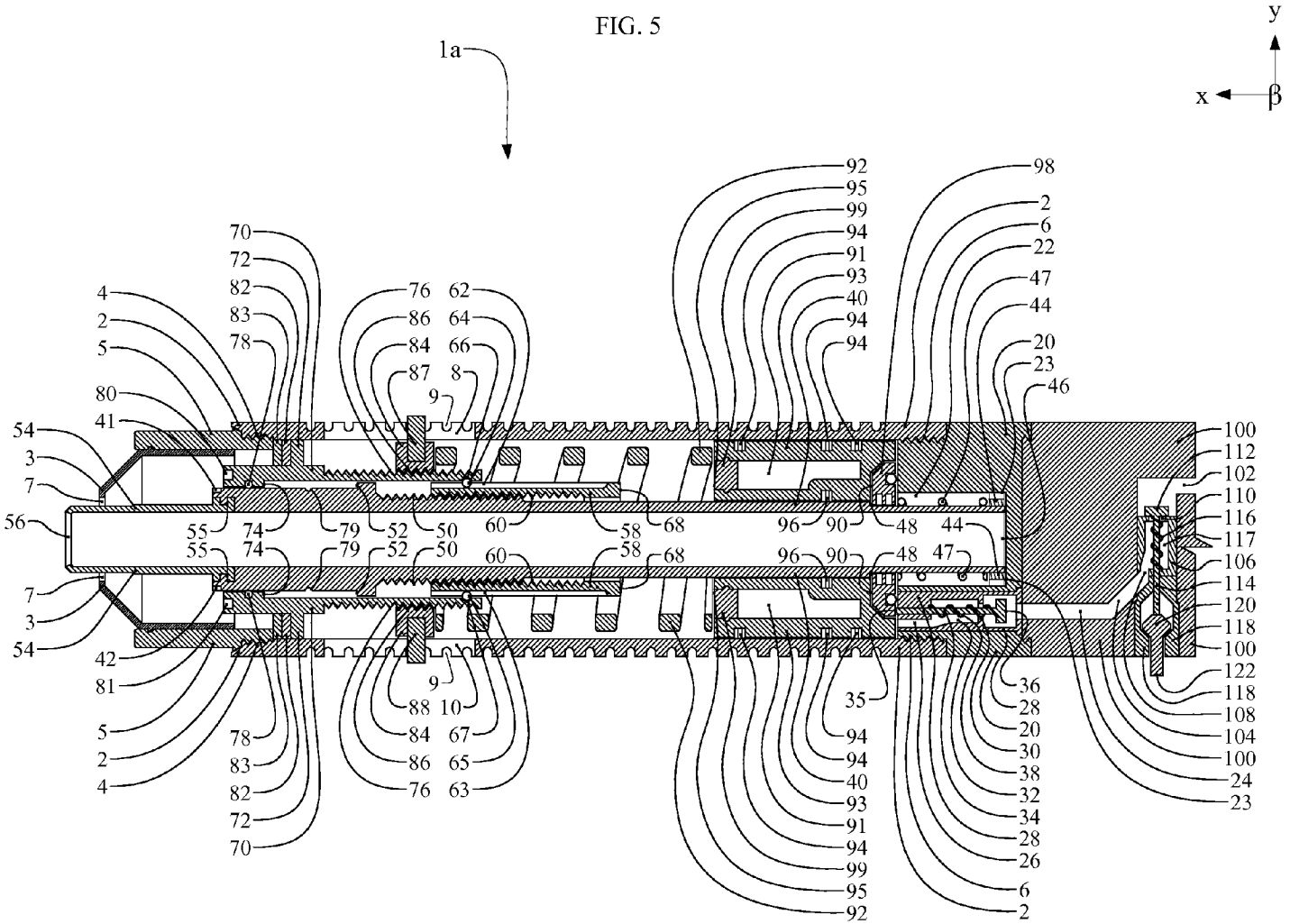
FIG. 5 depicts the assembly structure, further illustrating a spring footing mechanism oppositely longitudinally extended for enhanced resting point spring compression, according to embodiments disclosed herein.

FIG. 5 depicts the assembly structure 1*a*, further illustrating a spring footing mechanism 84 oppositely longitudinally extended for enhanced resting point spring compression, according to embodiments disclosed herein. As illustrated, the first spring 92 is oppositely longitudinally offset from the depiction of FIG. 2. This position changes the spring set point of the first spring 92, which in turn changes the pressure set point as the piston 93 advances in a longitudinal direction. By adjusting the spring footing mechanism 84 in an oppositely longitudinally direction, the resting compression of the first spring 92 is greater than when the spring footing mechanism 84 is disposed in a more longitudinally offset position. Consequently, the gas introduced into the cylinder space 97 must be introduced with a force great enough to move the piston 93 and further compress the first spring 92 (thereby creating the cylinder space 97 of FIGS. 6 and 7) until equilibrium is reached. As the piston 93 impinges upon the telescoping tube 58, the tubular linkage 40 on which the telescoping tube 58 is threaded advances longitudinally.

Additionally, the serrated flange 44 allows the passage of gas and compresses the second spring 47, which extends shouldering of the serrated flange 44. There is a difference in cross sectional area between the piston 93 and the ring seal body 98, which causes gas to apply more force to the piston 93 than the ring seal body 98. At this point, infinitesimal additional compression of the first spring 92 through the piston 93 (by the compressed gas), forces the ring seal body 98 to open against pressure in the cylinder 2.

FIG. 6 depicts the assembly structure 1*a*, further illustrating initial longitudinal motion of the piston 93, according to embodiments disclosed herein. As illustrated, at its most advanced point, the ring seal body 98 is forced open and the annular groove 79 encounters the ball bearing detent 78. This delays return of the tubular linkage 40 until the piston 93 returns. Also depicted in FIG. 6 is the creation of the cylinder space 97. As discussed above, the cylinder space 97 is created by the introduction of gas into the cylinder 2 via a valve mechanism, such as the gas inlet port 26. If the gas is introduced at a sufficient pressure, the gas will cause the piston 93 to overcome the spring set point, thereby compressing the first spring 92. This moves the piston 93 in a longitudinal direction, creating the cylinder space 97. The volume of the cylinder space 97 increases until the pressure of the gas and the spring set point (which increases as the spring is compressed) reach an equilibrium.

Specifically, upon user actuation of the trigger linkage 120, pressurized gas flow is conducted into a cylinder space 97 between the piston 93 and the Schrader valve 28. Upon the cylinder space 97 achieving a pneumatic pressure, by admitted flow of pressurized gas substantially equal to the opposing force imposed by the first spring 92 upon the piston 93, the piston 93 begins to travel longitudinally within the cylinder 2 against the proportionally increasing spring force of first spring 92, and the longitudinal surface of ring seal body 98 is no longer physically impinged by the oppositely longitudinal surface of the annular recess 90 and piston 93. The compressed gas within cylinder space 97 continues to translate the spring force of first spring 92 to the ring seal body 98 by association of the compressed gas in cylinder space 97 with piston 93, which continues to press the ring seal body 98 against its cylinder head 20 seating surface. As the first spring 92 is further compressed, the additional pressure required to compress the first spring 92 further increases instantaneously and gradually in proportion to the displaced distance.

Absent a mechanism for preventing pressurized gas flows out of the cylinder space 97 by ring seal body 98 and the tubular linkage 40, pressurized gas flow would communicate directly out through the oppositely longitudinal end of the tubular linkage 40 and, absent the ring seal body 98, the Schrader valve 28 would remain closed, preventing such flows from entering the cylinder space 97.

More specifically, the tubular linkage 40 may have a longitudinally and axially aligned annular passage 22 with open longitudinal and oppositely longitudinal ends and constituting a barrel tube through which a projectile may be launched. Upon launch, the tubular linkage 40 may function with a longitudinal motion, similar to a firearm slide and feed ramp. In some embodiments the tubular linkage 40 may function as a barrel extension, which upon longitudinal motion, may urge a projectile presented at its longitudinal end into the end of the barrel breach 1*e*. Thus, the tubular linkage 40 may function in a manner similar to a firearm breach bolt and bolt carrier assembly, as a reciprocating linkage providing automatic projectile loading and valve control functions by mechanism of annular shouldering features and associated additional components.

Additionally, the longitudinal end annular surface of the tubular linkage 40 presents a shallow groove that is longitudinally aligned with the pocketed ball bearing detent 78 presented at the longitudinal annular inner surface of the quill 70. Upon longitudinal displacement of the tubular linkage 40 to its longitudinal position, the ball bearing impinges upon the edges of the groove, maintaining its position until the pressurized gas within the cylinder 2 flows out through the cylinder space 97 between the oppositely longitudinal end of the tubular linkage 40 and the annular well presented at the longitudinal surface of the cylinder head 20 and into the open end of the tubular linkage 40 and thereby pneumatically launching the projectile presented at the breach end of the barrel through and out of the barrel. Upon evacuation of the pressurized gas, the piston 93 is urged toward its oppositely longitudinal position.

Additionally, the oppositely longitudinal recess surface of the piston 93 impinges upon the ring seal body 98, and at the direction of the first spring 92, urges the ring seal body 98 operatively toward its oppositely longitudinal position. This compresses a second spring 47 against the serrated flange 44 until the force applied to the serrated flange 44 by the associated second spring 47, ring seal body 98, and piston 93 exceeds the resistance of the ball bearing detent 78, at which time the tubular linkage 40 is urged toward its oppositely longitudinal position. The ball bearing detent 78 delays the return of the tubular linkage 40, allowing complete outflow of the compressed gas within the cylinder 2 and substantially simultaneously prevents undesirable premature oppositely longitudinal motion of the tubular linkage 40, which may reduce the gas pressure at the breach end of the barrel or cause uncontrolled oscillating motion of the linkage due to premature seating of the ring seal body 98.

Figure 11:
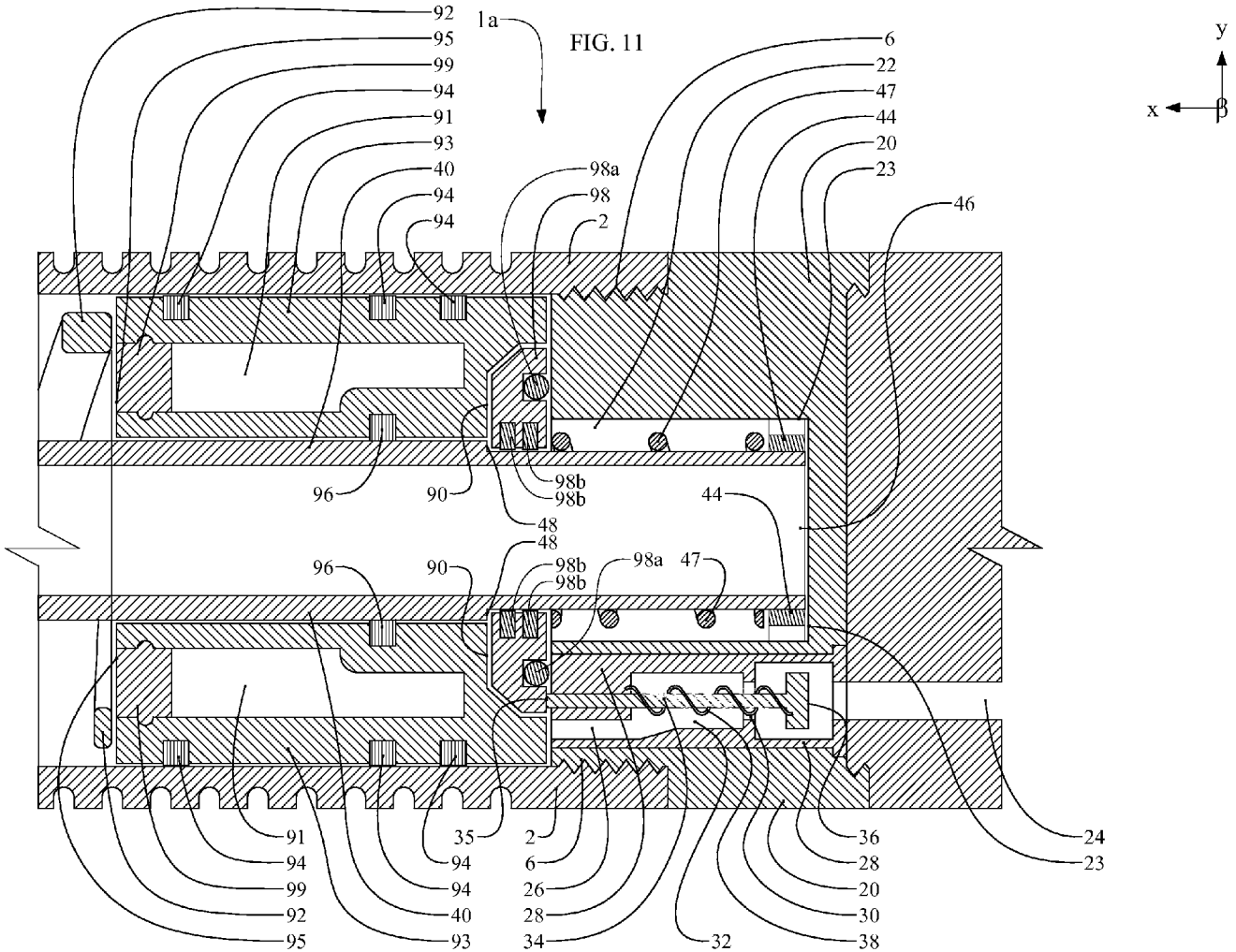
FIG. 11 depicts a ring seal body, according to embodiments disclosed herein.
Figure 12:
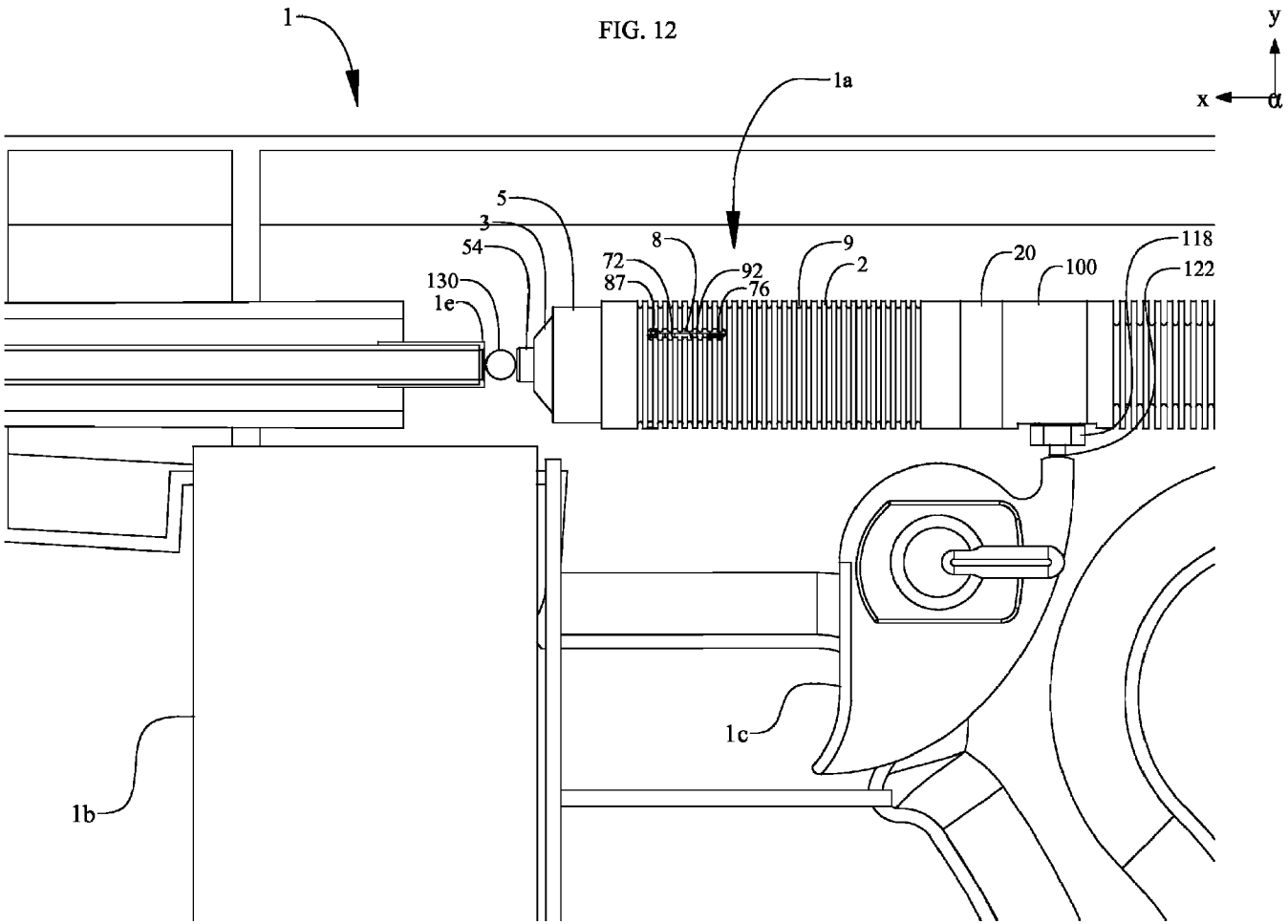
FIG. 12 depicts an application of the pneumatic cannon device, with the assembly structure mounted within the frame of a replica firearm, according to embodiments disclosed herein.

Upon actuation of the trigger linkage 120, the adapter nipple 54, affixed to the most longitudinal end of the tubular linkage 40, is also moved longitudinally to impinge upon a projectile which may be presented between the adapter nipple 54 and the barrel breach 1*e*, pressing the projectile into the breach and hermetically seating within the barrel breach 1*e* (FIGS. 1, 11, and 12). Substantially simultaneously, an annular groove 79 in the longitudinal annular surface of the tubular linkage 40 aligns with a ball bearing detent 78 presented within the interior annular surface of the longitudinal end of the quill 70. This delays the oppositely longitudinal motion of the tubular linkage 40 due to the incidental influences of friction between the piston inner seal 96 while the piston 93 is moving in an oppositely longitudinal direction. This occurs until the resistance of the ball bearing detent 78 is overcome by the first spring 92, the piston 93 impinging upon ring seal body 98, the second spring 47, and serrated flange 44. The longitudinal end of the quill 70 also presents pocketed ball bearings within the interior annular surface which are longitudinally aligned with an annular groove 79 on the longitudinal end of the tubular linkage 40, when the tubular linkage 40 is in its longitudinal position, and constituting a detent.

FIG. 7 depicts the assembly structure 1*a*, further illustrating continued longitudinal motion of the piston 93 along with carried longitudinal motions of the tubular linkage 40 and sealing ring components, according to embodiments disclosed herein. As the cylinder space 97 increases in volume, the first spring 92 continues to compress, until equilibrium is reached between the force to compress the first spring 92 and the pressure within the cylinder space 97.

Figure 8:
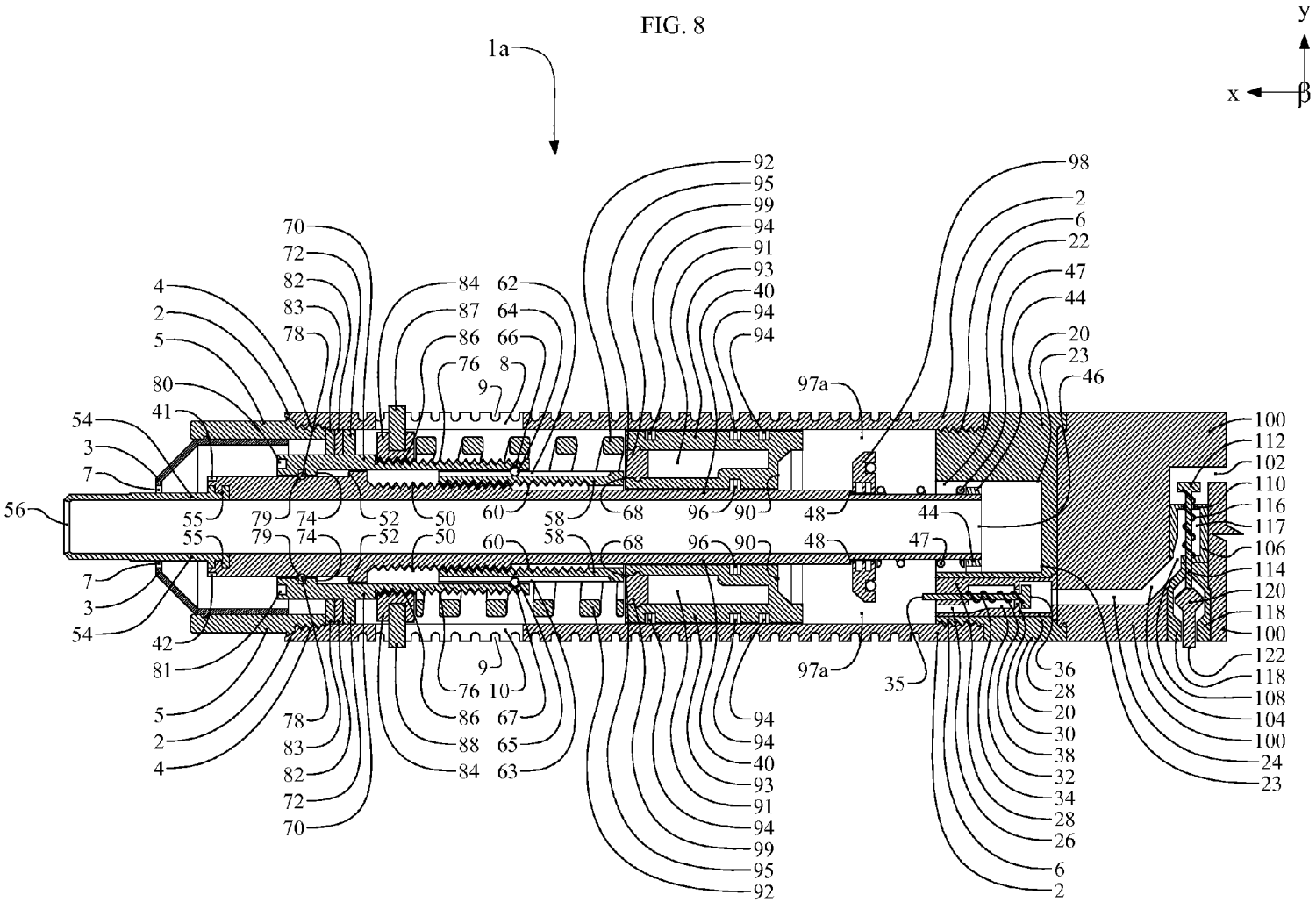
FIG. 8 depicts the longitudinal motion of the unseated ring seal body, as provided by the second spring, according to embodiments disclosed herein.

FIG. 8 depicts the longitudinal motion of the unseated ring seal body 98, as provided by the second spring 47, according to embodiments disclosed herein. As illustrated, the ring seal body 98 is positioned in its most longitudinal offset, while the majority of force is with the second spring 47. At this point, the piston 93 is returning to repeat the cycle, picks up the ring seal body 98, and compresses the second spring 47. This urges the serrated flange 44 oppositely longitudinally and overcomes the ball bearing detent 78, thereby forcing the tubular linkage 40 back into the position depicted in FIG. 2. An altered cylinder space 97*a* is created as the assembly structure 1*a* comes to include the annular passage 22 upon unseating of the ring seal body 98.

FIG. 9 depicts a rear loading version of the assembly structure 1*a*, according to embodiments disclosed herein. As illustrated, the structure of the assembly structure 1*a* in the rear loading pneumatic cannon device is substantially identical to the assembly structure 1*a* from FIGS. 2-8. The only differences lie in that the assembly structure 1*a* depicted in FIG. 9 (and FIG. 10) includes a projectile opening 125 for receiving a projectile 130 at an oppositely longitudinal position on the assembly structure 1*a*. While the embodiments of FIGS. 1 and 3-8 depict examples where the projectile opening 125 is located toward the longitudinal end of the assembly structure 1*a*, in some embodiments (such as depicted in FIGS. 9 and 10), the projectile opening 125 may be positioned on oppositely longitudinal end.

Additionally, it should be understood that while the projectile 130 in FIG. 9 is depicted as being spherical, this is merely an example. Depending on the particular embodiment, the projectile 130 may be presented at the longitudinal end of the pneumatic cannon device 1. In some embodiments, the interior passage of the tubular linkage 40 can be used as a barrel itself, and thus the projectile 130 may be loaded in a manner similar to a feed ramp of an automatic pistol.

FIG. 10 depicts the rear loading version of the assembly structure 1*a*, as it applies to the portion of the operational cycle, according to embodiments disclosed herein. As illustrated in FIG. 10 (and in conjunction with FIG. 9), the projectile 130 may be further loaded into position for firing from a rear feed mechanism.

FIG. 11 depicts a ring seal body 98, according to embodiments disclosed herein. As illustrated, the close-up view of the assembly structure 1*a* is depicted and includes elastomeric rings 98*a* and slidable elastomeric annular seals 98*b*. The elastomeric rings 98*a* are present in the oppositely longitudinal surface of the ring seal body 98. The ring seal body 98 compresses against the associated longitudinal surface of the cylinder head 20, thereby hermetically covering the annular passage 22. Additionally the slidable elastomeric annular seals 98*b* are closely fit and compressed against the associated surface of the tubular linkage 40.

FIG. 12 depicts an application of the pneumatic cannon device 1, with the assembly structure 1*a* mounted within the frame of a pneumatic cannon device 1, according to embodiments disclosed herein. As illustrated, the projectile 130 may be loaded into the barrel breach 1*e* by the adapter nipple 54. As discussed above, the adapter nipple 54 is coupled (directly and/or indirectly) to the frangible cap 3, which is coupled to the annular sleeve 5. From this position, the assembly structure 1*a* may propel the projectile through the barrel breach 1*e*.

Figure 13:
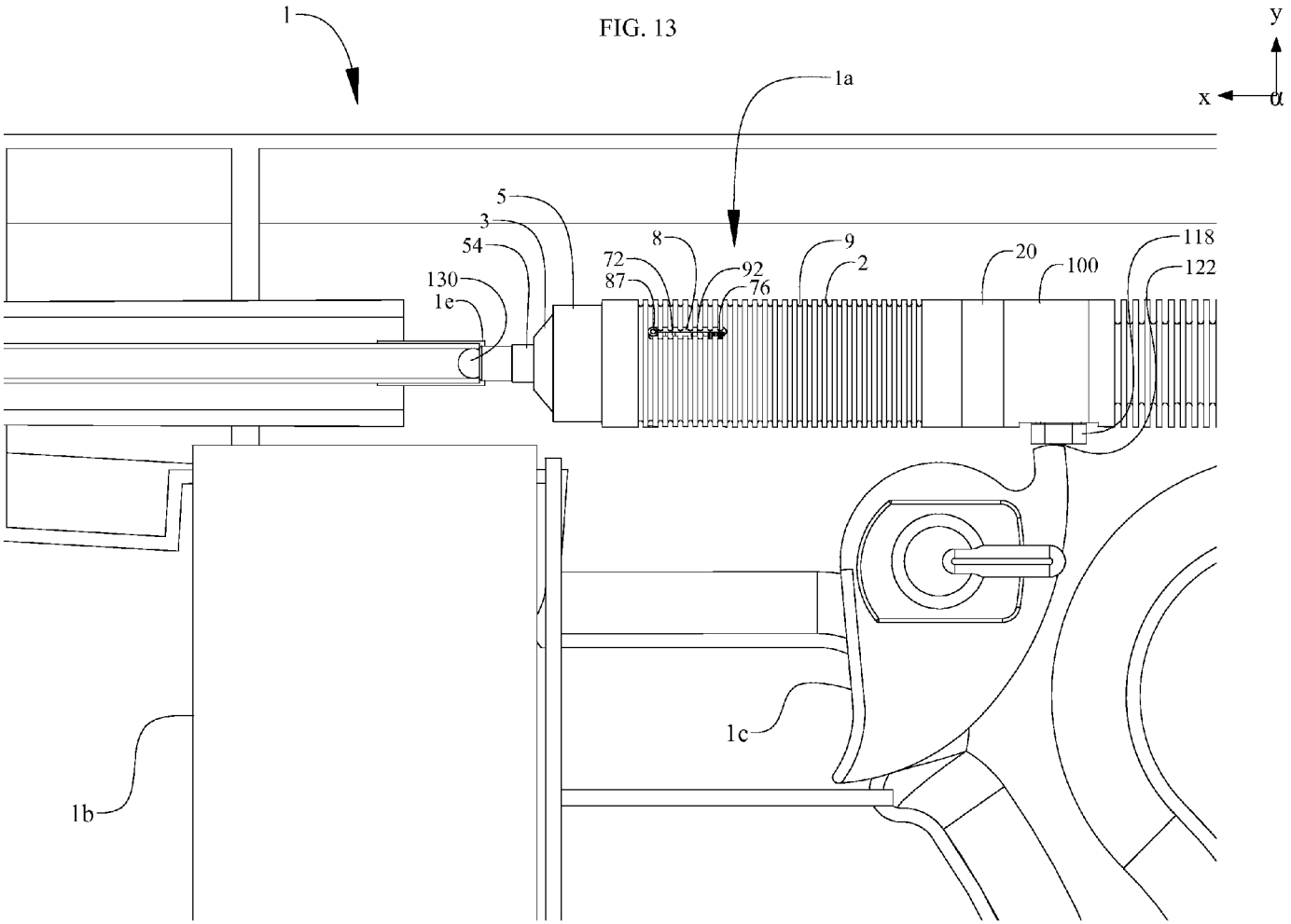
FIG. 13 depicts the pneumatic cannon device, further illustrating loading a projectile, according to embodiments disclosed herein.

FIG. 13 depicts the pneumatic cannon device 1, further illustrating loading a projectile, according to embodiments disclosed herein. Referring back to FIG. 12, prior to pulling the trigger 1*c*, the trigger linkage actuation surface 122 is not depressed. However, upon actuating the trigger 1*c*, the trigger linkage actuation surface 122 depresses, thereby causing the projectile 130 to be forced by the assembly structure 1*a* through the barrel breach 1*e*.

With the structural description provided with regard to FIGS. 3-13 above, operation of the pneumatic cannon device 1 may begin when the trigger 1*c* is actuated and pressurized gas is admitted from the gas reservoir 1*d*. This causes a flow of pressurized gas to a gas supply conduit 102 when the Schrader valve body 106 is opened and not otherwise (FIGS. 2-10). Prior to user activation, the piston 93 rests against the longitudinal surface of the cylinder head 20, pressing the ring seal body 98 against the longitudinal surface of the cylinder head 20 by the force of the first spring 92 (which is translated by the piston 93 to the ring seal body 98). The second spring 47 translates that force from the ring seal body 98 to the serrated flange 44 and to the associated tubular linkage 40. Substantially simultaneously, the ring seal body 98 also depresses the Schrader valve 28, opening it to gas flow. The piston 93, ring seal body 98, and tubular linkage 40 reside in their most oppositely longitudinal positions within the assembly structure 1*a* and the Schrader valve 28 is open. The adapter nipple 54 associated with the tubular linkage 40 is retracted, permitting a new projectile 130 to be presented to the barrel breach 1*e* and the gas pressure within the cylinder space 97 approximates ambient air pressure.

Upon actuation of the Schrader valve body 106, pressurized gas is permitted to flow from the gas reservoir 1*d* to the gas supply conduit 108 superior to the Schrader valve 28, through the open Schrader valve 28, to the gas inlet port 26, into the cylinder space 97 (FIGS. 6 and 7) oppositely longitudinal to the piston 93. As gas is admitted to the cylinder space 97 (FIGS. 6 and 7), the first spring 92 is first overcome by equal gas pressure, causing the pressure on the ring seal body 98 also to rise to the pressure applied by direct contact with the piston 93 oppositely longitudinal recess surface. As gas continues to enter the cylinder space 97, the pressurized gas associates with both the piston 93 and ring seal body 98 to extend the first spring 92 to the ring seal body 98. Gas entering the cylinder space 97 compresses the piston 93 longitudinally against the first spring 92 and also compresses the ring seal body 98 against its associated longitudinal cylinder head 20 seating surface. This also keeps the Schrader valve stem 34 compressed, which continues to remain open to gas flow. The piston 93 continues to move longitudinally to impinge its longitudinal surface upon the oppositely longitudinal surface of the telescoping tube and the associated tubular linkage 40 and the serrated flange 44 associated with the tubular linkage 40. The piston 93, telescoping tube 58, and tubular linkage 40, and serrated flange 44 continue their longitudinal travel while the pressurized gas within the cylinder space 97 continues to press the ring seal body 98 against the cylinder head 20 longitudinal seating surface, while the second spring 47 between the serrated flange 44 and ring seal body 98 becomes depressed by mechanism of the inflowing gas pressure and the associated compilation of parts associated with the serrated flange 44.

As the second spring 47 compresses to solid such that each coil of the second spring 47 impinges upon the adjacent coil. The second spring 47 constitutes a shouldering extension associated with the serrated flange 44. Being of larger cross-sectional area, the force applied to the piston 93 by the pressurized gas in the cylinder space 97 (FIGS. 6 and 7) exceeds the force applied by the ring seal body 98 by the same pressurized gas. Further admission of gas to the cylinder 2 forces the ring seal body 98 open against the force of the gas pressure, unseating the ring seal body 98, and allowing the second spring 47 to slide the ring seal body 98 longitudinally, abruptly opening the cylinder head 20 annular passage 22 to admit gas flows to and past the serrated flange 44, and into the open end of the tubular linkage 40. Substantially simultaneously, the ball bearing detent 78 at the longitudinal end of the tubular linkage 40 engages with the groove located on the annular surface of the tubular linkage 40 and placed so as to allow this coincidental event. Also substantially simultaneously, the cylinder head 20 Schrader valve stem 34, no longer depressed by the ring seal body 98, closes by its own associated spring mechanism, interrupting additional gas flows through the cylinder head gas inlet port 26 and into the cylinder space 97.

As pressurized gas flows out of the cylinder space 97, past the serrated flange 44 out of the assembly structure 1*a* through the interior of the tubular linkage 40, the piston 93 advances oppositely longitudinally by the first spring 92, closely approximately maintaining the pressure of the out-flowing gas preventing or ameliorating pressure drop in the barrel due to expansion of the propellant gas thus maintaining the projectile impulse during launch.

Upon the piston 93 retreating to its oppositely longitudinal position, the ring seal body 98 is once again pressed against the cylinder head 20 longitudinal seating surface and the cylinder head 20 Schrader valve stem 34 is once again depressed, opening the gas inlet port 26 to pressurized gas flow.

If the Schrader valve body 106 remains open, this cycle of operation repeats until the pressure in the gas reservoir 1*d* falls below the pressure required to compress the first spring 92 to its furthest longitudinal position. This causes the assembly structure 1*a* to fail rather than to perform at below its user selected limits, resulting in consistently predictable internal ballistic acceleration, and predictable projectile velocity and trajectory upon leaving the barrel.

Additionally, the telescoping tube 58 may be adjusted to provide an optimum economy of gas used by adjusting the longitudinal impingement point, and thus the cylinder space 97 volume which must be displaced with pressurized gas to cause unseating of the ring seal body 98, thus making the assembly structure 1*a* tunable to provide the optimal volume of pressurized gas without waste for any particular barrel length.

Accordingly, the spring footing mechanism 84 may be adjusted to change the first spring 92 pre-load force advancing the loading curve for the spring and thus providing an increase or decrease of the pressure present in the cylinder space 97 at the time the ring seal body 98 is unseated permitting the user to regulate the resulting velocity and ballistic energy of the launched projectile, for repeatable precise trajectories and terminal ballistic energies.

Figure 14A:
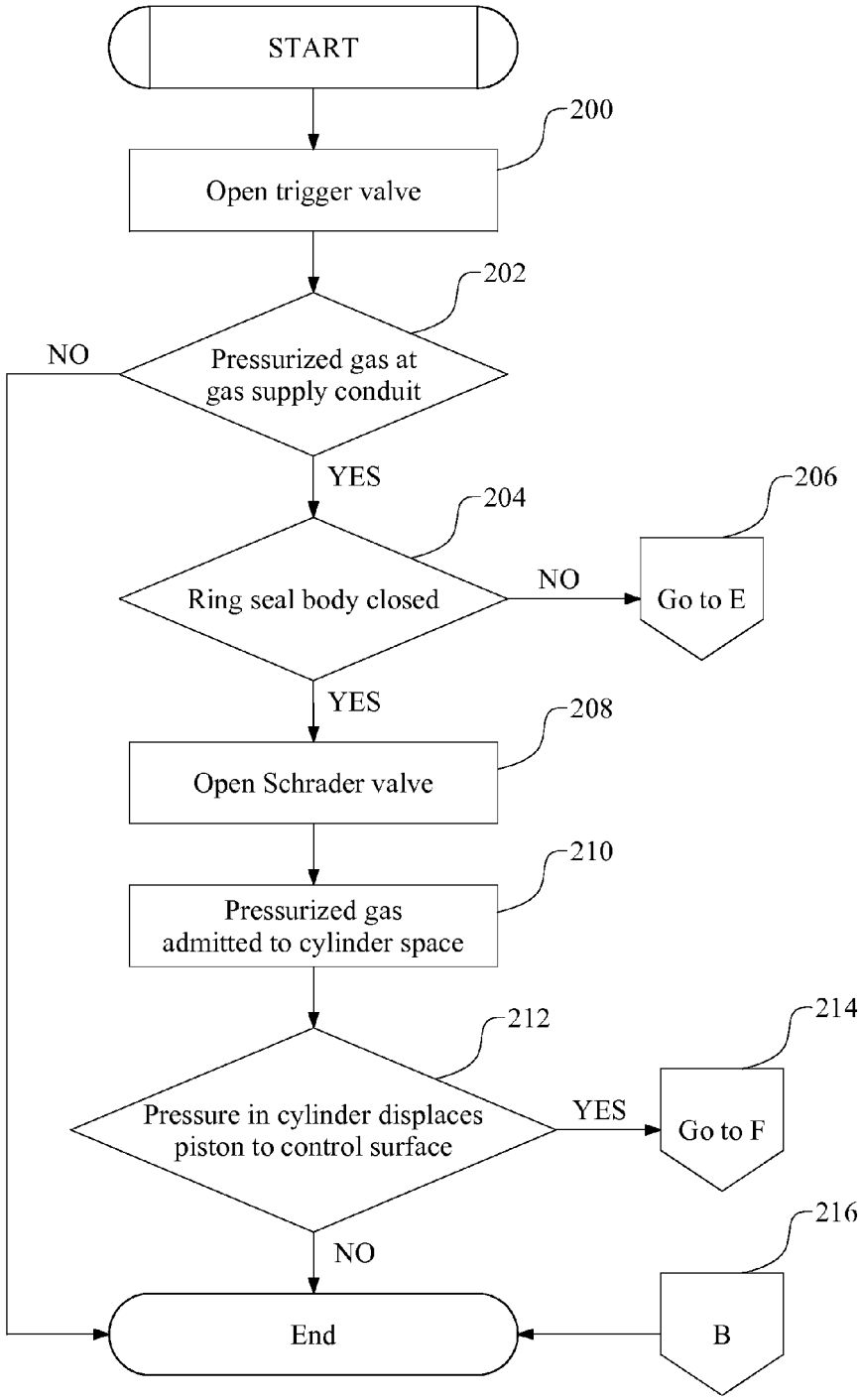
FIGS. 14A-14C depict a process for discharging a projectile, utilizing the assembly structure, according to embodiments disclosed herein.
Figure 14B:
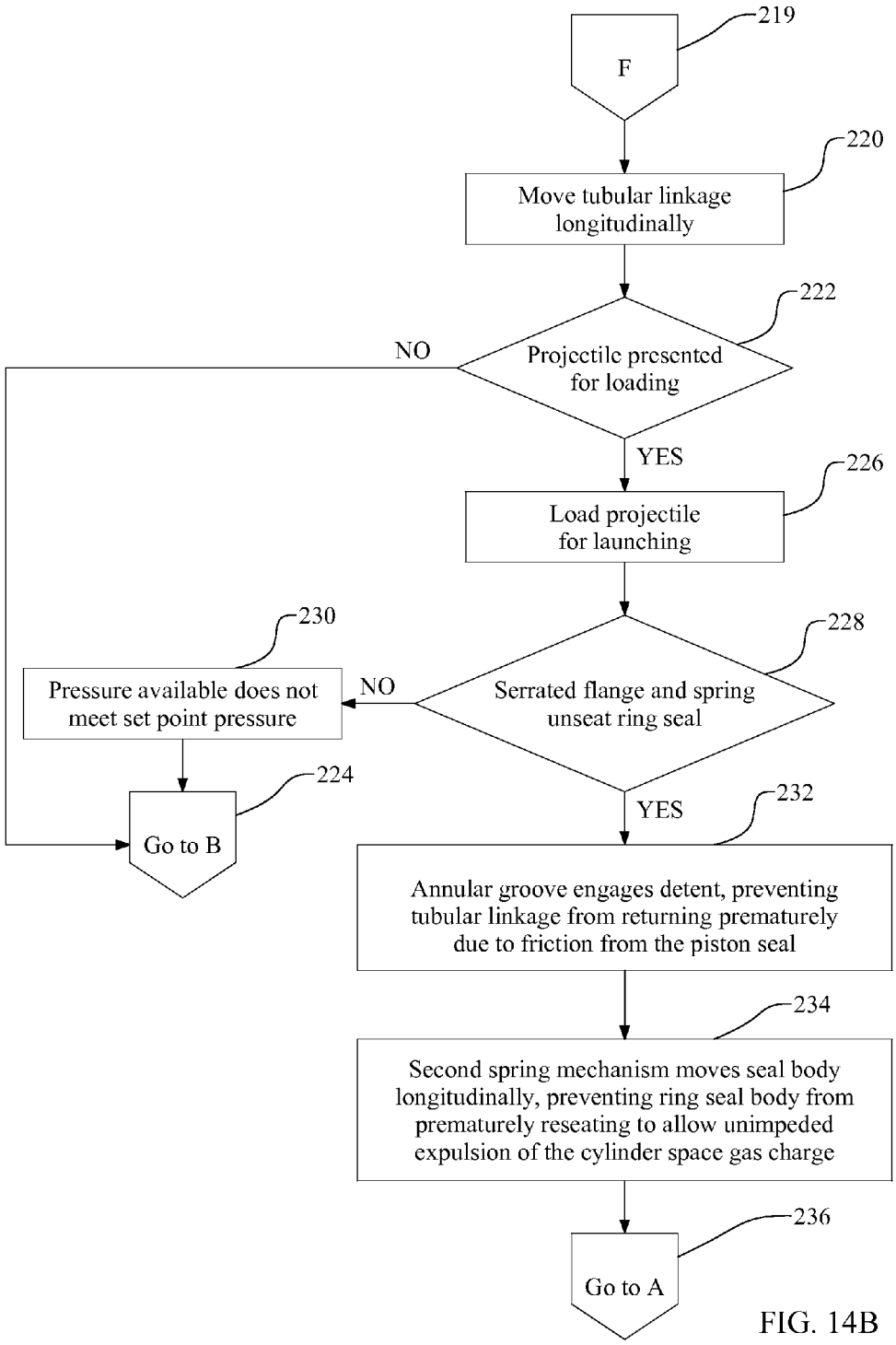
Figure 14C:
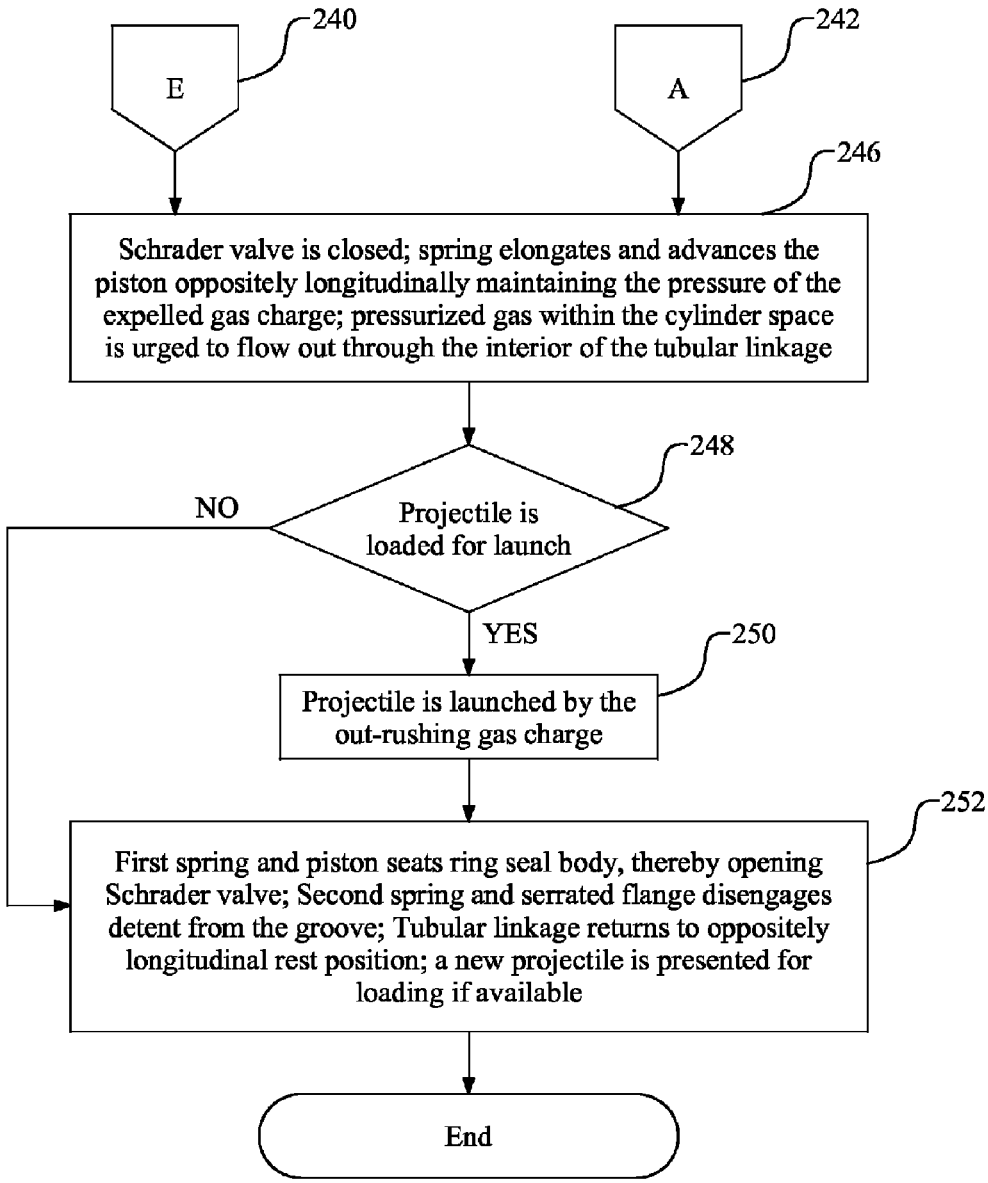

In a similar context, FIGS. 14A-14C depict a process for discharging a projectile 130, utilizing the assembly structure 1*a*, according to embodiments disclosed herein. As illustrated at block 200 of FIG. 14A, the Schrader valve body 106 may be opened. At block 202 a determination may be made regarding whether pressurized gas is present at the gas supply conduit 102. If not, the projectile 130 may not be launched and the process may end. If pressurized gas is present at the gas supply conduit 102, at block 204 a determination may be made whether the ring seal body 98 is closed. If not, the process may proceed to jump block 206. If so, at block 208, the Schrader valve 28 may be opened. At block 210, the pressurized gas may be admitted to the cylinder space 97. At block 212, a determination may be made regarding whether pressure in the cylinder space 97 displaces the piston 93 to the control surface 68. If so, the process may proceed to jump block 214. If not, the projectile 130 may not be launched.

Referring now to FIG. 14B, from jump block 214 in FIG. 14A, the process proceeds from jump block 219 to block 220, where the tubular linkage 40 may be moved longitudinally. At block 222, a determination is made regarding whether the projectile 130 is presented for loading. If not, the flowchart proceeds to jump block 224, which is continued in FIG. 14A at jump block 216. From jump block 216 in FIG. 14A, the projectile 130 may fail to launch and the process may end.

If at block 222 (FIG. 14B), the projectile 130 is presented for loading, the projectile 130 may be loaded for launching. At block 228 a determination is made regarding whether the serrated flange 44 and second spring 47 unseat the ring seal body 98. If not, at block 230 the pressure available does not meet the set point pressure. The process may then proceed to jump block 224, where the projectile 130 may fail to launch and the process may end. If at block 228, the serrated flange 44 and the second spring 47 unseat the ring seal body 98, at block 232 the annular groove 79 engages the ball bearing detent 78, preventing the tubular linkage 40 from returning prematurely due to friction from the piston inner seal 96. At block 234, the second spring 47 moves the ring seal body 98 longitudinally, preventing the ring seal body 98 from prematurely reseating to allow unimpeded expulsion of the cylinder space 97 gas charge. The process may then proceed to jump block 236, continued in FIG. 14C.

In FIG. 14C, the process may proceed from jump block 240 (from FIG. 14A) or from jump block 242 (from FIG. 14B). Regardless, at block 246, the Schrader valve 28 may be closed, preventing additional pressurized gas from entering the cylinder space 97. The first spring 92 may additionally elongate and advance the piston 93 oppositely longitudinally, maintaining the pressure of the expelled gas charge. Also, the pressurized gas within the cylinder space 97 is urged to flow out through the interior of the tubular linkage 40. At block 248, a determination may be made regarding whether the projectile 130 is loaded for launch. If so, at block 250, the projectile is launched by the out-rushing gas charge. If at block 248, the projectile is not loaded for launch (or proceeding from block 250), the first spring 92 and the piston 93 seat the ring seal body 98, thereby opening the Schrader valve 28. The second spring 47 and the serrated flange 44 may additionally disengage the ball bearing detent 78 from the annular groove 79. The tubular linkage 40 may additionally return to the oppositely longitudinal rest position and a new projectile is presented for loading, if available.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

As indicated above, embodiments disclosed herein provide systems and methods for regulating pneumatic gas propulsion. More specifically, embodiments include an assembly structure 1*a* that receives pressurized gas for utilization in a pneumatic cannon device. While many current solutions provide inconsistent ballistic air pressure for launching a projectile, embodiments of this disclosure regulate the pressure of gas received from a gas reservoir, such that consistent delivery of gas to the projectile 130 may be achieved. More specifically, embodiments disclosed herein regulate the pressure of the gas by including a first spring that has a set point that must be met before gas is dispensed from the pneumatic cannon device. If the set point is never met, embodiments disclosed herein will simply not dispense any gas. Additionally, embodiments disclosed herein may further improve performance of the pneumatic cannon device by providing a user configurable setting to determine the set point of the first spring. With this function, the user can control the power that the pneumatic cannon device dispenses gas and thus launches the projectile.

Therefore, at least the following is claimed:

1. A system for regulating pneumatic gas propulsion comprising:

a cylinder including at least one longitudinal slot;

a first spring located within the cylinder, wherein the first spring exerts a spring force in an oppositely longitudinal direction;

a piston that is in physical communication with the first spring;

a spring footing mechanism that is coupled to the first spring, the spring footing mechanism being positioned on a longitudinal side of the first spring from the piston to define an initial force of a spring set point, wherein the spring set point is substantially equivalent to a gas force in a longitudinal direction to overcome the spring force to thereby compress the first spring, wherein the spring set point increases as the first spring is compressed;

a protruding pin coupled to the spring footing mechanism, wherein the protruding pin removably engages the at least one longitudinal slot to constrain rotation of the spring footing mechanism, wherein at least a portion of the protruding pin protrudes beyond an exterior portion of the cylinder, and wherein the portion of the protruding pin is user-accessible to provide a user with access to the spring footing mechanism;

a valve mechanism that is coupled to a gas reservoir and in physical communication with the piston, the valve mechanism receiving the gas from the gas reservoir, wherein upon the gas being received by the valve mechanism at a pressure that meets the spring set point, the gas causes the piston to move in the longitudinal direction, wherein movement of the piston in the longitudinal direction creates a cylinder space between the piston and the valve mechanism, wherein a volume of the cylinder space is defined by a position of the piston and retains the gas, wherein upon the pressure meeting the spring set point, the pressure causes the piston to compress the first spring until an equilibrium exists between the gas force and the spring force thereby releasing the gas;

a ring seal body coupled to the piston and movably positioned between the valve mechanism and the piston;

a cylinder head adjacent the ring seal body, the cylinder head defining an annular passage;

a second spring coupled to the ring seal body, wherein the first spring urges the second spring toward the ring seal body to compress the second spring and to unseat the ring seal body in the longitudinal direction upon equilibrium of the gas force and the spring force, and wherein the first spring urges the ring seal body in the oppositely longitudinal direction upon the gas being evacuated through the annular passageway;

a tubular linkage comprising an open longitudinal end that is opposite the cylinder head, wherein the tubular linkage is operatively connected to the annular passage, and wherein an end of the tubular linkage is removably engaged with a portion of the annular passage to control release of the gas through the open longitudinal end of the tubular linkage;

a barrel breach coupled to the tubular linkage, wherein the barrel breach defines a hollow portion for directing the projectile in a predetermined direction; and a trigger that is coupled to the barrel breach, wherein the gas is released upon a user activation of the trigger and equilibrium between the gas force and the spring force thereby launching the projectile through the barrel breach.

2. The system of claim 1, wherein the valve mechanism comprises at least one of the following: a Schrader valve and a gas inlet port, and wherein the system further comprises a frangible cap that provides a tamper seal to provide evidence of regulation of the assembly structure.

3. The system of claim 1, wherein upon the pressure not meeting equilibrium between the gas force and the spring force and a trigger being activated by a user, no gas is released from the system.

4. The system of claim 1, wherein at least one of the following is user-adjustable: the volume and the pressure.

5. A system for regulating pneumatic gas propulsion comprising:

a gas reservoir that stores gas for launching a projectile;

an assembly structure that is coupled to the gas reservoir, the assembly structure comprising:

a first spring that exerts a spring force in an oppositely longitudinal direction, wherein a position of the first spring defines a spring set point, wherein the spring set point is substantially equivalent to a gas force in a longitudinal direction to overcome the spring force to compress the first spring, wherein the spring set point increases as the first spring is compressed;

a piston that is in physical communication with the first spring; and a valve mechanism that is coupled to the gas reservoir and in physical communication with the piston, the valve mechanism receiving the gas from the gas reservoir, wherein upon the gas being received by the valve mechanism at a pressure that meets the spring set point, the gas causes the piston to move in the longitudinal direction, wherein movement of the piston in the longitudinal direction creates a cylinder space between the piston and the valve mechanism, wherein a volume of the cylinder space is defined by a position of the piston and retains the gas, wherein upon the pressure meeting the spring set point, the pressure causes the piston to compress the first spring until an equilibrium exists between the gas force and the spring force thereby releasing the gas;

a barrel breach that is coupled to the assembly structure, wherein the barrel breach defines a hollow portion for directing the projectile in a predetermined direction; and a trigger that is coupled to the assembly structure and the barrel breach, wherein upon a user activation of the trigger and equilibrium between the gas force and the spring force, the projectile is launched by the gas in the cylinder space through the barrel breach.

6. The system of claim 5, wherein the assembly structure further comprises a spring footing mechanism that is coupled to the first spring, the spring footing mechanism being positioned on a longitudinal side of the first spring from the piston, wherein a position of the spring footing mechanism on the assembly structure further defines the spring set point, and wherein the position of the spring footing mechanism is user-adjustable.

7. The system of claim 5, wherein the system is configured as at least one of the following: a front loading pneumatic cannon device and a rear loading pneumatic cannon device.

8. The system of claim 5, wherein the assembly structure further comprises a second spring and a ring seal body, wherein the second spring is coupled to the ring seal body, wherein the first spring urges the ring seal body toward the second spring, thereby compressing the second spring.

9. The system of claim 5, wherein the valve mechanism comprises at least one of the following: a Schrader valve and a gas inlet port, and wherein the assembly structure further comprises a frangible cap that provides a tamper seal to provide evidence of regulation of the assembly structure.

10. The system of claim 5, wherein upon the pressure not meeting equilibrium between the gas force and the spring force and the trigger being activated by a user, no gas is released from the assembly structure.

11. The system of claim 5, wherein the system comprises at least one of the following: a ball bearing (BB) gun, an airsoft gun, a pellet gun, and a paintball gun.

12. The system of claim 5, wherein at least one of the following is user-adjustable: the volume and the pressure.

13. A system for regulating pneumatic gas propulsion comprising:

a gas reservoir that stores gas for launching a projectile; and an assembly structure that is coupled to the gas reservoir, the assembly structure comprising:

a first spring that exerts a spring force in an oppositely longitudinal direction, wherein a position of the first spring defines a spring set point, wherein the spring set point is substantially equivalent to a gas force in a longitudinal direction to overcome the spring force to compress the first spring, wherein the spring set point increases as the first spring is compressed;

a piston that is in physical communication with the first spring;

a valve mechanism that is coupled to the gas reservoir and in physical communication with the piston, the valve mechanism receiving the gas from the gas reservoir, wherein upon the gas being received by the valve mechanism at a pressure that meets the spring set point, the gas causes the piston to move in the longitudinal direction, wherein movement of the piston in the longitudinal direction creates a cylinder space between the piston and the valve mechanism, wherein a volume of the cylinder space is defined by a position of the piston and retains the gas, wherein upon the pressure meeting the spring set point, the pressure causes the piston to compress the first spring until an equilibrium exists between the gas force and the spring force thereby releasing the gas;

a ring seal body coupled to the piston and movably positioned between the valve mechanism and the piston, wherein the ring seal body seals an annular passage until the equilibrium exists between the gas force and the spring force; and a second spring coupled to the ring seal body, wherein the first spring urges the second spring toward the ring seal body to compress the second spring.

14. The system of claim 13, wherein the assembly structure further comprises a spring footing mechanism that is coupled to the first spring, the spring footing mechanism being positioned on a longitudinal side of the first spring from the piston, wherein a position of the spring footing mechanism on the assembly structure further defines the spring set point, and wherein the position of the spring footing mechanism is user-adjustable.

15. The system of claim 13, wherein the system comprises at least one of the following: a front loading pneumatic cannon device and a rear loading pneumatic cannon device.

16. The system of claim 13, wherein the valve mechanism comprises at least one of a Schrader valve and a gas inlet port, and wherein the assembly structure further comprises a frangible cap that provides a tamper seal to provide evidence of regulation of the assembly structure.

17. The system of claim 13, wherein upon the pressure not meeting equilibrium between the gas force and the spring force and a trigger being activated by a user, no gas is released from the assembly structure.

18. The system of claim 13, wherein the system comprises at least one of the following: a ball bearing (BB) gun, an airsoft gun, a pellet gun, and a paintball gun.

19. The system of claim 13, wherein at least one of the following is user-adjustable: the volume and the pressure.

20. The system of claim 6, further comprising:

a cylinder including at least one longitudinal slot; and a protruding pin coupled to the spring footing mechanism, wherein the protruding pin removably engages the at least one longitudinal slot to constrain rotation of the spring footing mechanism, wherein at least a portion of the protruding pin protrudes beyond an exterior portion of the cylinder, and wherein the portion of the protruding pin is user-accessible to provide a user with access to the spring footing mechanism.

21. The system of claim 8, further comprising:

a cylinder head adjacent to the ring seal body, the cylinder head defining an annular passage; and a tubular linkage operatively connected to the annular passage, wherein an end of the tubular linkage is removably engaged with a portion of the annular passage to control release of the gas through an open longitudinal end of the tubular linkage, wherein the open longitudinal end is opposite the cylinder head.

22. The system of claim 13, further comprising:

a cylinder head adjacent to the ring seal body, the cylinder head defining an annular passage; and a tubular linkage operatively connected to the annular passage, wherein an end of the tubular linkage is removably engaged with a portion of the annular passage to control release of the gas through an open longitudinal end of the tubular linkage, wherein the open longitudinal end is opposite the cylinder head.

23. The system of claim 14, further comprising:

a cylinder including at least one longitudinal slot; and a protruding pin coupled to the spring footing mechanism, wherein the protruding pin removably engages the at least one longitudinal slot to constrain rotation of the spring footing mechanism, wherein at least a portion of the protruding pin protrudes beyond an exterior portion of the cylinder, and wherein the portion of the protruding pin is user-accessible to provide a user with access to the spring footing mechanism.

* * * * *